US005857415A

United States Patent [19]

Richard

[11] Patent Number: 5,857,415

[45] Date of Patent: Jan. 12, 1999

[54] ERGONOMIC COMPUTER WORKSTATION AND METHOD OF USING

[76] Inventor: Paul E. Richard, 109 Madison Ct., North Wales, Pa. 19454

[21] Appl. No.: 513,300

[22] Filed: Aug. 10, 1995

Related U.S. Application Data

[63] Continuation-in-part of Ser. No. 111,142, Aug. 24, 1993, Pat. No. 5,522,323.

[51] Int. Cl.[6] ..... A47B 35/00

[52] U.S. Cl. ..... 108/50.01; 108/147; 108/10

[58] Field of Search ..... 108/50, 147, 10, 108/50.01, 50.02; 312/223.3, 194, 196; 248/920, 917, 918, 919, 921, 922, 923

[56] References Cited

U.S. PATENT DOCUMENTS

| | | | |
|---|---|---|---|
| 4,691,886 | 9/1987 | Wendling et al. | 248/920 X |
| 4,729,533 | 3/1988 | Hillary et al. | 248/920 X |
| 4,834,329 | 5/1989 | Delapp | 248/923 X |
| 4,852,500 | 8/1989 | Ryburg et al. | 108/50 X |
| 4,989,813 | 2/1991 | Kim et al. | 248/920 X |
| 5,041,770 | 8/1991 | Seiler et al. | 248/919 X |
| 5,218,876 | 6/1993 | Lindsay | 248/281.11 X |
| 5,398,622 | 3/1995 | Lubinskas et al. | 248/281.11 X |
| 5,437,235 | 8/1995 | Randolph . | |
| 5,501,420 | 3/1996 | Watt et al. | 248/919 X |
| 5,522,323 | 6/1996 | Richard | 108/50 X |

*Primary Examiner*—José V. Chen
*Attorney, Agent, or Firm*—C. A. Wilkinson, Esq.

[57] ABSTRACT

A computer workstation is provided with a movable support for a video monitor which is counterbalanced such that it may be moved with a minimum exertion and a coordinated keypad for support of the keyboard for the computer is also arranged in a counterbalanced fashion for movement with a minimum exertion by the operator, both of such structures being coordinated together to provide a universally adjustable monitor work system station which both allows and encourages the operator to periodically make adjustments in the position of the various components so as to decrease or eliminate repetitive strain-type injuries which may be brought on by long continued exactly repetitive movements. The video monitor is adjustably supported with a dual adjustable support.

18 Claims, 8 Drawing Sheets

Fig. 11
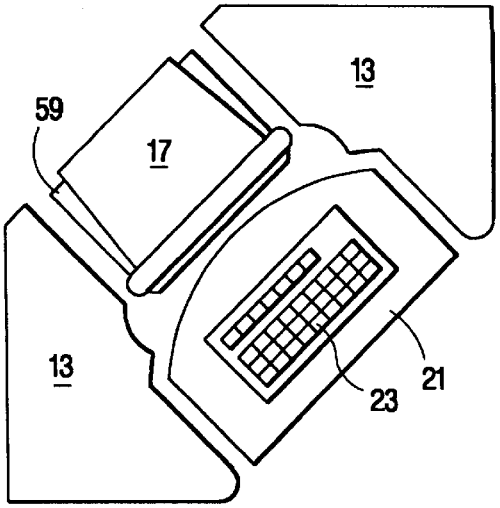
Fig. 12
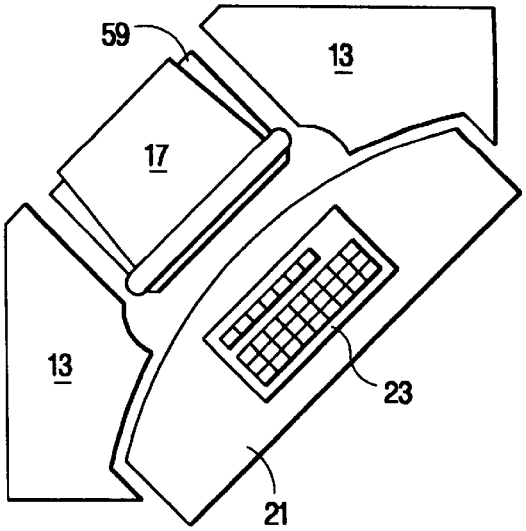
Fig. 13
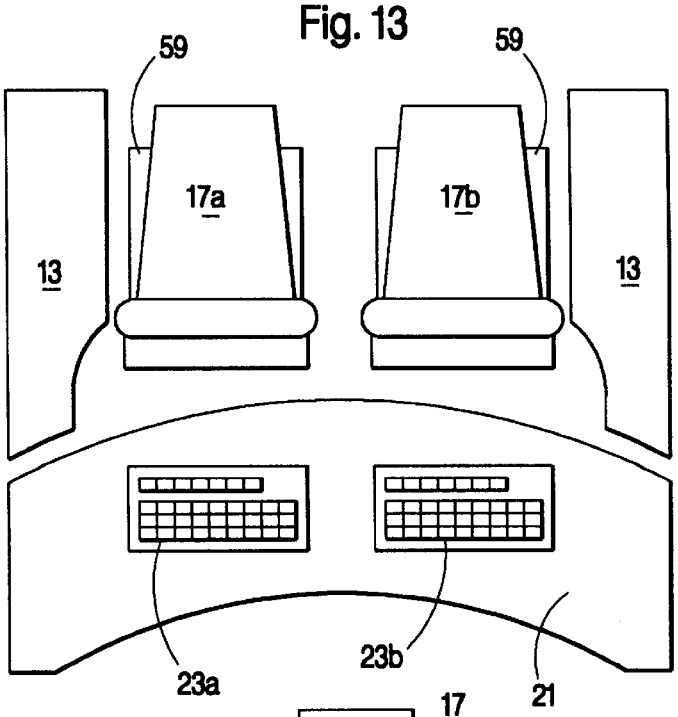
Fig. 14
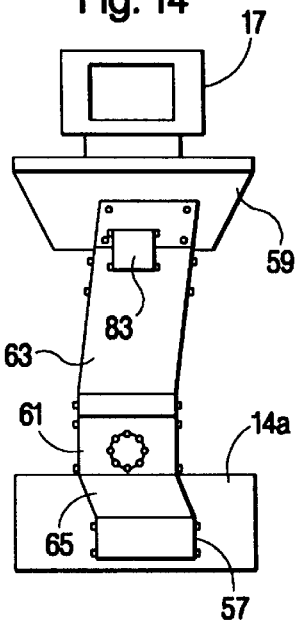
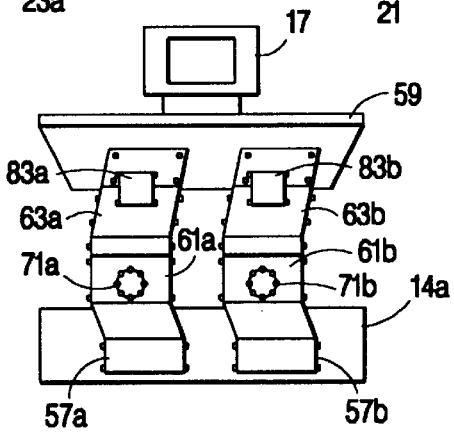
Fig. 15

ERGONOMIC COMPUTER WORKSTATION AND METHOD OF USING

REFERENCE TO RELATED APPLICATIONS

This application is a continuation-in-part of U.S. application Ser. No. 08/111,142 filed Aug. 24, 1993 now U.S. Pat. No. 5,522,323 by the same inventor for an "Ergonomic Computer Workstation and Method of Using".

BACKGROUND OF THE INVENTION

1. Field of the Invention

This invention relates to the field of computer accessories and more particularly to the field of workstations for computer terminals. More particularly still this invention relates to ergonomically designed workstations for computers which workstations minimize the development of debilitating work related illnesses and symptoms due to so-called repetitive strain injury, frequently referred to as RSI.

2. Description of the Prior Art

Computers, and particularly small digital computers, commonly referred to as personal or microcomputers (PC's), or occasionally also minicomputers, have become one of the most ubiquitous and rapidly proliferating developments of modern technology. Such computers have become almost indispensable business and scientific tools, used by nearly every level of worker from the lowest level clerk to corporate managers and presidents as well as by many individuals in their own homes, both for business and for recreation. The inherent speed of the electronic computer, which speed ever increases and allows it to handle masses of data and almost impossible calculations, makes the digital computer one of the most widely used as well as the most representative tools of the modern age. Once learned, the techniques of computing multiply the effectiveness of single individuals in handling repetitive data and as well as the speed and accuracy of complicated calculations and are responsible for the computer within a few short years, becoming almost a "wonder machine".

With the development and growth of the use of computers, a great number of accessory devices have been developed to enhance their basic effectiveness as well as to make the working environment of the computer operator more pleasant and efficient. However, along with the extraordinary benefits of the computer have come a number of persistent problems, including health problems. One of the greatest of these is related to the very nature of the computer, i.e. its astounding ability to handle masses of data and to accept instructions very quickly.

A computer itself, and particularly the digital, small computer, derives much of its flexibility from its ability to take a large number of repetitive instructions quickly and efficiently and to operate using such instructions at a very rapid rate. Normally an operator must provide the computer with its basic instructions and, in many cases, much of its original data, which means that an operator must operate the keyboard of the computer to either feed in data to the computer or program it. However, operators are subject to error and, since a computer is basically a stupid machine, which must either operate with whatever instructions and data it is provided or reject such data, causing the processing of the data to stop until corrections are made, it is necessary for the operator to check as the instructions are fed to the computer that, in fact, the proper instructions are being entered. Such verification operation is accomplished by having a Video Display Terminal (VDT) in the form of a cathode ray tube (CRT) upon which the instructions which are being fed to the computer are displayed for simultaneous checking by the operator. The VDT also displays instructions to or warnings to the operator from the computer to either guide the operator's handling of the data or instruction input or to warn the operator of malfunctions or mistakes.

The introduction of the VDT or Video Display Terminal for checking the operation of the computer, as well as the efficiency of the operator in coding in instructions, introduced a new factor into the environment of those who had traditionally operated keyboards, i.e. typists or typewriter operators who used a familiar keyboard which, after some practice, was memorized and required little actual monitoring. The typist operator previously could either let his or her eyes wander or, if typing data from a written memorandum, could focus upon the memorandum, which was placed very near to the keyboard. Such printed material has been traditionally placed fairly close to the keyboard so that the eye span between the keyboard and the material being typed is relatively small, minimizing the effort involved in moving the eyes from one to the other and also minimizing difficulty in focusing on both the material being typed and the keyboard. In transcribing dictation, furthermore, the typist's eyes have traditionally been able to wander, while their fingers flew over the keyboard, converting the words of the dictation into printed material, which was checked from time to time by the typist's eyes. Even with such minimum movements of the eyes, however, the repetitive hand and finger movement necessary in typing could become extremely tiring after several hours and the typist frequently also encountered strain due to the repetitive motion of the typing itself, even after much practice.

The introduction of the Video Display Terminal, or VDT, upon the introduction of computers with a conventional large monitor, however, introduced a new element into the equation of bodily comfort and health in that the video monitor required fairly frequent periodic checking to make certain the correct information was being applied to the keyboard. With the small restricted size of certain monitors applied to a conventional typewriter somewhat after the introduction of computers, the problem introduced by the monitors was not particularly great, because the monitor itself was small and was invariably mounted directly on top of the typewriter so that it was very close to the keys of the typewriter and required only a minimum movement of the eyes to focus upon. However, the normal Video Display Terminal or VDT associated with a computer is of fairly large dimensions so that it may be easily readable by the operator when there is a large amount of data displayed upon it.

Consequently, the very size of the video monitor prevented such monitor from being normally placed in close association with the keyboard of the computer. The video monitor, furthermore, because of it size, normally is fairly heavy and requires a substantial support, if it is to be secure. As a result, the custom grew of placing the video monitors or VDT, upon a conventional desk top, which invariably has sufficient strength to support the VDT along with the computer itself, and to have the keyboard attached to the computer by a cable so that the keyboard could be easily placed in front of the monitor.

In recent years the video monitor has increased very significantly in size so it can display more data at a time, particularly in spreadsheet form, while still providing a readable display. Such large monitors introduce significant difficulties in placement and support of the monitor in a convenient position for the operator.

Within a short time after the introduction of the VDT, specialized desks or "workstations" were developed, usually incorporating a basic desk or working top and frequently having shelves on the back for the receipt of various associated equipment. By connecting the CPU, or Central Processing Unit, to the keyboard and to the monitor by separate cables and/or wiring, the CPU could either be placed upon the desk top or on one of the shelves and the video monitor could also be placed either upon the desk top or working surface or upon the CPU cabinet or upon one of the shelves and the keyboard could be placed by the operator in whatever location they wished upon the work surface. The video monitor, therefore, became traditionally placed at about eye level in front of the operator while the keyboard was placed in front of the video monitor on the work surface. Various operators, however, might place the video monitor upon any work surface they found convenient and comfortable and place the keyboard in a position on the available work surface which they found comfortable.

Since long hours are normally worked in front of a computer by the operator, it was found that the operator, after a few hours, might become very uncomfortable. Statistical studies of the complaints of computer operators have found very elevated occurrences of musculoskeletal discomfort in Video Display Terminal operators, as compared with other workers during similar work, for example, typists. Statistical studies have shown a high correlation between VDT use and shoulder, neck and other discomfort and pain as well as so-called "wrist tendonitis". Such various discomforts and disorders may be broadly referred to as "repetitive strain injuries" (RSI) or sometimes cumulative trauma disorders. Such RSI disorders or injuries usually occur when a person repeats the same motion many thousands of times a day. It is exactly this type of repetitive motion which is most characteristic of the operation of computer terminals, particularly in those cases where the operator must essentially type for long periods such as is done by stenographers and data processing personnel.

Not only are there repetitive motions of the hands in the basically typing of data into a computer terminal, but the operator is continuously glancing from the keyboard, which incorporates certain keys which even the skilled typist normally has not memorized, to the video terminal to check on the data which is being fed into the computer. This also requires continuous movement of the eyes back and forth between the computer terminal and the keyboard and also sometimes to a third work surface where material in printed form is displayed which is being fed into the computer. In some cases, it may be necessary only to move the eyes, particularly if the operator does not wear glasses. However, because of the normal distance between the keyboard and the monitor as a result of the size of the monitor, the movement of even the eyes quickly tires the muscles of the eyes providing eye strain and, where the head is moved, such movement of the head and neck quickly leads to musculoskeletal discomfort of the neck, particularly in older operators.

Thus, one of the serious problems related to use of a computer terminal is that of neck and back strain. This is created by continuously sitting in a difficult position due often to the location of the monitor, the keyboard or both in relation to the position of the operator's chair. Particularly if the monitor is at a distance or is far off center, as is, in fact, sometimes preferred by some operators, at least initially, the operator may sit in a basically uncomfortable position for long periods of time. Furthermore, if the keyboard is too far from the operator's seat or is an uncomfortable height, a similar discomfort may rapidly occur. Thus, during the working periods of a computer operator, since it is frequently necessary to look from the monitor screen and back again in order to perform various tasks, if the computer equipment components, i.e. the keyboard and the video monitor, are not in advantageous or comfortable positions, strain to the muscles of the neck and the eyes may quickly occur.

It has been suggested before that it is ergonomically preferable to have the keyboard and the monitor screen located fairly close to each other and at about equal height, as well as at customarily comfortable distances from the eye of the user in order to minimize head movements and eye focusing adjustments, which may, after a long, continued activity, produce considerable physical stress in the muscles and related structure and physiology of the operator.

Incorrect keyboard and monitor screen positioning are particularly taxing to computer operators who wear corrective lenses, since such operators may have relatively little ability to focus their eyes easily at different distances or may even frequently be reduced to peering at one or the other or both of the monitor screen and the keyboard around the edges of bifocal corrective lenses.

One particular problem relating to the operation of computers which has been forced more and more prominently upon the attention of both medical and industrial hygiene personnel in recent years is the RSI or cumulative trauma disorder commonly known as carpel tunnel syndrome. Carpal tunnel syndrome is an unusually debilitating injury to the wrist joint frequently attributed to very long continued repetitive hand motions. Because the median nerve and flexor tendons of each hand pass through a relatively small opening in the wrist joint known as the carpel tunnel, if the walls of such tunnel become constricted, pressure may be placed upon the nerves in particular, and cause pain which can at times become excruciating. Long continued activities of the hand involving strain on the wrist combined with repetitive finger articulations may result in swelling of the carpel tunnel walls such that pressure is exerted upon the median nerve where it passes through the carpel tunnel with resulting pain, tingling and numbness of the fingers which are typical symptoms of carpel tunnel syndrome. The usual medical treatment involves either complete immobilization of the wrist for a period of time to allow the swelling to decrease or disappear, or, alternatively, surgery to relieve the pressure or basically enlarge the carpel tunnel area so that considerable more swelling is necessary to cause serious pressure upon the nerve. However, it has been found that once carpel tunnel syndrome occurs, the likelihood of a recurrence is fairly high. Considerable lost work time may thus occur because of carpel tunnel syndrome and the loss of the services of skilled computer operators through temporary inability to operate computer terminals and/or necessary transfer to other tasks assumes very large proportions. Carpel tunnel syndrome, in fact, now constitutes a fairly large proportion of workmen's compensation-type injury and many industries have been seeking a solution.

There have been a number of recent studies to determine various ways of preventing the occurrence of repetitive strain injury, or RSI, in computer operators and various computer manufacturers have undertaken to design equipment which is adapted to lower the probability of the development of RSI by computer operators. Such equipment has depended largely upon improving the operator's position relative to the video monitor at the workstation so as to minimize stress upon the wrist, forearms and shoulders of the operator. Various improvements including the use of arm rests, wrist rests, and foot rests in conjunction with Video Display Terminals, or VDT, workstations have been tried and various means for locating computer screens and keyboards of computer workstations to make the station more comfortable have been developed or tried. In most of these arrangements the aim has been to allow the computer operator to adjust the position of the VDT, or Video Display Terminal, to a particularly comfortable viewing position as well as to adjust the keyboard to a position favored by the operator. In addition, operators have been trained to use easier and lighter keystrokes and particularly to take more frequent rests. While all these expedients have tended to decrease repetitive strain injury, or cumulative trauma disorders, the large problem of Repetitive Strain Injury, or RSI, has not been completely solved by any means and carpel tunnel syndrome, in particular, continues to be a serious problem among computer operators, not to mention the traditional "pain in the neck" and/or headache which seem to be particularly prevalent among computer operators and typists. One attempt to legislate an end to the problem has been that undertaken by the city of San Francisco which within the last several years passed an ordinance requiring certain equipment standards for employees whose duties include routine repetitive keyboard motions for more than four hours, inclusive of breaks per any eight-hour shift. Such ordinance makes it mandatory for employers to provide such operators with user adjustable workstations and chairs that meet various minimum standards, including provision for arm rests, wrist rests and foot rests, if the operator so requests, to enable the operator to maintain a neutral position of the wrist while at the workstation keyboard.

As a result of the problems set forth above, various attempts at solving repetitive strain injury difficulties have been made by various inventors and manufacturers as set forth, for example, in the following patents which have been issued within the past several years.

U.S. Pat. No. 4,381,714 issued May 3, 1983 to H. H. Henneberg et al. discloses an early vertically adjustable computer console table using a gas cylinder to infinitely adjust a computer work surface to attain the best height for the operator in order to increase efficiency and contribute to health.

U.S. Pat. No. 4,637,322 issued Jan. 20, 1987 to J. F. Hampshire et al. discloses an adjustable work table for computers which is tilted by means of a compound arcuate tilting mechanism and support activated by a rack and pinion arrangement which allows the arcuate supporting members to rock the arcuate tilting mechanism with a minimum of vibration. The workstation supporting table is also adjustable with respect to height by a scissors arrangement. Both the tilting mechanism and the elevating scissors arrangement are operated by rotating knobs. It is stated that the supporting surface for the cathode ray tube can be adjusted both vertically and rotationally about a horizontal axis to align with the operator's line of vision.

U.S. Pat. No. 4,852,500 issued Aug. 1, 1989 to J. B. Ryburg et al. discloses a computer workstation in which in general, the monitor or CRT and the keyboard are mounted upon movable slides, Preferably the central processing unit is also mounted upon the slide upon which the CRT is mounted and the CRT is in turn mounted upon a fairly long articulated arm which is in turn mounted upon the CRT slide. Such articulated arm allows the CRT to be moved upwardly and downwardly as well as moved in and out while the slide provides sidewise movement. Consequently, the CRT is provided essentially with universal movement or adjustability albeit with a rather expensive arrangement. The keyboard is not coordinated with the movement of the CRT support arm, but merely slides toward and away from the operator. One aim of the Ryburg et al. arrangement is to be able to move the CRT out of the way at the workstation when not being used. Several alternative articulated arm arrangements are shown for the monitor, all of which are mounted on slides.

U.S. Pat. No. 5,033,804 issued Jul. 23, 1991 to S. M. Faris discloses a unitary workstation mounted centrally upon a desk. The station is basically in the form of a unitary module. The unitary workstation module may be essentially rotated or positioned with various inclinations from flat matching the desk top to almost vertical depending upon the operator's inclination or desire either manually pivoting or by pivoting or rocking with power means. The CRT is mounted behind glass in the center of the module and the keyboard is mounted at the bottom. All the parts of the station including the CPU are contained in the module below the CRT and keyboard so no movable cables are involved. The keyboard does not appear to be individually adjustable with respect to the position of the CRT monitor.

U.S. Pat. No. 5,041,770 issued Aug. 20, 1991 to M. A. Seller et al. discloses a computer workstation in which the monitor and keyboard are supported upon separate elevatable supports. The supports are operated by electric motors. The monitor support can be moved forward and backward as well as up and down and the keyboard support can be moved to various angles. An adjustable wrist support is also provided adjacent the keyboard support. One of the expressed objects of the invention is said to be to allow the supports to be quickly and easily adjusted by the user to prevent the tasks being performed from being repetitive with possible physical injury such as carpel tunnel syndrome. Adjustment is by power means.

U.S. Pat. No. 5,044,284 issued Sep. 3, 1991 to M. Gross discloses a computer workstation in which either the CRT or the entire computer combined with the CRT is mounted upon an adjustable shelf which is pivoted at the front and supported in the rear with a belt such that tightening the belt results in adjusting the angle of the shelf and the CRT support thereupon. The forward-rear position of the CRT or computer may be adjusted by the position of a rear panel on the shelf. A separate forward shelf is positioned in front of the CRT and pivoted at the near end in slots in the shelf supporting structure and supported by a pivot arm supporting the shelf on the opposite side. It is said that the position of the two shelves can be adjusted with a minimum of effort by the operator while seated to obtain a comfortable position of the two for use by the operator.

The adjustments are clearly not intended to be done frequently, but only when adjusting the workstation for a new operator.

U.S. Pat. No. 5,071,204 issued Dec. 10, 1991 to M. J. Price et al. discloses a desk-type computer workstation having a transparent central top with a CRT monitor supported at an angle on an adjustable shelf under the top. A keyboard is slideably mounted on a tray with a conventional drawer slide in front of the monitor shelf. The monitor shelf can be adjusted upwardly and downwardly and to various angles of inclination as desired by a variable pin arrangement, but is not readily adjustable at will.

U.S. Pat. No. 5,094,514 issued Mar. 10, 1992 to P. O. Grosch discloses a computer workstation furniture-type piece in which the CRT and frequently the computer also are mounted or supported upon a shelf within an opening below the main work surface. The shelf is mounted on a series of alternate pegs or the like in an inclined position. The top of the workstation furniture piece opens or pivots up to allow the operator to view the screen of the CRT and has a surface on its underside upon which printed material may be supported immediately above the CRT screen. A keyboard shelf meanwhile pulls out so it is available to the operator and also is out of the way of the operator's line of sight to the CRT screen.

U.S. Pat. No. 5,118,172 issued Jun. 2, 1992 to C. V. Ugalde discloses a computer workstation having an in-and-out sliding keyboard support at normal operating height plus an inclined shelf in back of and below such shelf to support the monitor in a position so that the operator may move his or her eyes only minimally up and down to shift their view from the keyboard to the monitor and back. The operator's view of the monitor is always maintained downwardly at an angle.

U.S. Pat. No. 5,120,117 issued Jun. 9, 1992 to C. L. Williams discloses an ergonomically designed computer station comprised of a plastic tray-type support designed to be mounted within a cutout section of a desk or counter top. The depth of the tray is designed to place the keyboard at a good physiologic height of about 26.5 inches recommended for typewriters from the floor when mounted in a standard 29.5 inch worktable height. The monitor position is set at a small angle from the keyboard section. There is also a wrist support. There are no adjustable features.

U.S. Pat. No. 5,161,760 issued Nov. 10, 1992 to W. H. Terbrack discusses at some length the medical problems associated with long continued repetitive movements and provides adjustable arm, wrist and hand rests to aid in support of the arm and hand during use of a computer keyboard.

U.S. Pat. No. 5,174,223 issued Dec. 29, 1992 to M. K. Nagy et al. discloses a computer workstation having an elevation means for raising or lowering of the computer support table. Attached to the table is a keyboard stand that can be inclined to various positions and incorporates an arm rest to aid in supporting the arms. This is alleged to provide an ergonomically arranged workstation.

U.S. Pat. No. 5,174,224 also issued to M. K. Nagy et al. on Dec. 29, 1992 is a continuation-in-part of the previous Nagy patent showing a keyboard support.

While, as will be recognized from the above, there have been a number of efforts to decrease the problem of Repetitive Strain Injuries, or RSI, and each of such efforts has, in fact, been successful to a certain extent or degree, no overall solution has been as yet found. While providing a comfortable workstation certainly tends to alleviate the symptoms of RSI for a period of time and while it is recognized that due to variations in build, physical condition and personal idiosyncrasies, it is advantageous to allow a computer operator to be able to adjust the position of the video monitor and the keyboard to his or her own most comfortable positions and that this will tend to at least considerably delay the development of actual symptoms of RSI, such symptoms continue ultimately to manifest themselves among many computer operators.

After a long continued study or this problem, the present inventor has found that the previous workers have been largely directing their efforts towards mere palliatives or decreases of the symptoms rather than directly addressing the heart of the RSI problem. After long continued study, the inventor has established the following, (a) that while it is advantageous to have the computer operator adjust the components of the workstation to the most comfortable position for that particular computer operator, that said comfortable position continues for only a relatively short time, (b) after a given position becomes uncomfortable, the operator must be able to assume a different position quickly and easily, and (c) that the operator will only assume a more comfortable position if the apparatus can be adjusted instantaneously and with no significant effort.

The applicant inventor, therefore, has developed a computer workstation system which allows and encourages the operator to adjust the relationship of the video monitor and the keyboard in an infinitely variable number of relationships with respect to the operator as operation of the computer continues so that former completely repetitive motions become significantly changed, and due to such change in the overall repetitive motion due to the change in position, RSI injury is significantly decreased and operator comfort is materially enhanced. Applicant inventor accomplishes these aims by taking into account certain physiological relationships and has developed an apparatus which can be conveniently readjusted by the computer operator, not only whenever such operator becomes uncomfortable, but at any time the notion strikes the operator or preferably at rather frequent intervals whereby the repetitive motions of the eyes and the fingers and the hands which are essentially inherent in the operation of a keyboard and a computer monitor are continuously slightly varied throughout the work period so that they are not exactly the same, but are continuously changing, thus very greatly enhancing the comfort of the operator and the aim of eliminating RSI injury. Furthermore, the operator essentially becomes responsible for their own comfort by maintaining healthful operating equipment parameters so that the operator can himself or herself determine how likely he or she is to develop RSI injury.

OBJECTS OF THE INVENTION

It is an object of the present invention, therefore, to provide a computer workstation which will enable the operator to periodically change the parameters of such workstation in order to achieve a rest of the body parts which participate in movement during operation of the computer.

It is a further object of the invention to provide a workstation system in which the computer monitor and keyboard can be universally adjusted with respect to the eye of the operator within certain physiologically desirable limits.

It is a still further object of the invention to provide a computer workstation in which the monitor is supported by a counterbalance support enabling the monitor to be raised or lowered with minimum effort by the operator and also to be moved forward or backward toward or away from the operator a predetermined distance which contributes to alleviating RSI injury.

It is a still further object of the invention to provide a universally adjustable keyboard pad which can be adjusted within predetermined limits in an infinite number of relative positions with respect to an imaginary triangle extending between the eye of the computer operator, the keyboard and the computer monitor.

It is a still further object of the invention to establish a triangular relationship between the eye of the computer operator, the video monitor and the keyboard of a computer workstation which triangle is infinitely adjustable within predetermined physiologically desirable parameters between the positions of the three apexes of the triangle.

It is a still further object of the invention to provide supports for a computer keyboard and a video monitor terminal which can be essentially adjusted by mere finger pressure of the operator to a desired position of the keyboard and the video monitor.

It is a still further object of the invention to provide a computer workstation having a video monitor support arranged such that the inclination of the video monitor is automatically adapted to change as the video monitor is either lifted or urged downwardly so that the video screen remains always directed at the eye of the operator.

It is a still further object of the invention to provide a counterbalanced support for a video monitor which will completely support said monitor securely and without vibration in any position which the operator may place it by mere finger pressure.

It is a still further object of the invention to provide a support for a keyboard pad which is counterbalanced such that the pad will be securely supported in any position which the operator places it by finger pressure and will remain in such position during operation of the keyboard until the operator readjusts the keyboard pad.

It is a still further object of the invention to provide a counterbalanced support means for a keypad which may be varied in position, including up and down positions and inclination, essentially by minimum finger pressure of the operator and which may then be locked in position to form a secure work surface.

It is a still further object of the invention to provide a keyboard pad which is infinitely adjustable within predetermined limits and which may be locked in any position by a simple hand motion until it is desired by the operator to reposition such keyboard pad.

It is a still further object of the invention to provide an overall computer workstation system which may enable the computer operator to assume responsibility for placing the keyboard pad and video monitor in continuously changing positions relative to each other and to the operator which will prevent long continued identical repetitive motions from occurring.

It is a still further object of the invention to provide a video monitor which can be positioned easily at the critical resting eye convergence angle of the operator at different angles of the computer monitor stand.

It is a still further object of the invention to provide a computer workstation system in which the support of the computer monitor is infinitely adjustable within predetermined limits with respect to the height of the monitor and the forward and rearward position of the monitor with regard to the operator as well as in which the monitor is inclined always towards the position of the operator's eyes and in which the keyboard pad is infinitely adjustable within predetermined limits such that the keyboard can be adjusted with respect to the operator both in an upward and downward direction, in a forward and backward direction and with respect to inclination of the keypad.

It is a still further object of the invention to provide a keypad support for a computer keyboard which keypad has rounded surfaces which will not cut into body parts of the operator during operation of the keyboard.

It is a still further object of the invention to provide a computer workstation having at series of interchangeable keypads designed to accommodate various functions of the computer including minimum space and expanded space for accessories and other advantages.

It is a still further object of the invention to provide a computer workstation which is easily integrable with various office decor as well as to provide the operator of a computer with a maximum comfort resistance to RSI syndrome, while at the same time, maintaining a predetermined decor of the office.

It is a still further object of the invention to provide an ergonomically designed computer workstation which will minimize the development of Repetitive Strain Injuries, or RSI, by allowing the computer operator to adjust the monitor position and computer pad position periodically at short intervals into various positions so that long continuous repetitive motions are not engaged in.

It is a still further object of the invention to provide a method of operating a keyboard and monitor for a computer in a manner whereby long continued exactly duplicative repetitive motions are avoided.

Further objects and advantages of the invention will become apparent from the following description and explanation in conjunction with the appended drawings.

BRIEF DESCRIPTION OF THE INVENTION

A computer workstation is provided having adjustable supports for the video monitor and the keyboard pad which are universally adjustable with respect to each other and to the location of the operator within predetermined limits in which the keyboard pad can be adjusted with a minimum of effort upwardly and downwardly and back and forth and can be locked readily in position during use, such lock being readily deactivated and the monitor can be adjusted up and down and back and forth and is automatically inclined as it moves up and down to have the face of the monitor always face the operator's line of sight, such monitor being easily moved by the operator essentially unaided to any new position the operator desires and being designed specifically so the operator will, with a minimum of urging, be encouraged to adjust the relative positions of the keyboard and monitor with respect to the operator periodically at short intervals to avoid long continued exactly duplicative or exactly repetitive movements. The invention can be applied to both large and small minitor installations.

BRIEF DESCRIPTION OF THE DRAWINGS

FIG. 11 is a diagrammatic plan similar to FIG. 10 showing a somewhat different embodiment of the invention also incorporated into a corner position in a cubicle-type office plan.

FIG. 12 is a still further diagrammatic plan view of an embodiment having a larger or super-sized keypad, or keyboard support, in a corner position.

FIG. 13 is a still further diagrammatic plan view of an embodiment of the invention incorporating two monitors and keypads at a single workstation.

FIG. 14 is a diagrammatic front elevation of an adjustable support arm in accordance with the invention supporting a video monitor.

FIG. 15 is a diagrammatic front elevation of an adjustable double support arm in accordance with the invention supporting an oversized video monitor.

DESCRIPTION OF THE PREFERRED EMBODIMENTS OF THE INVENTION

Figure 1:
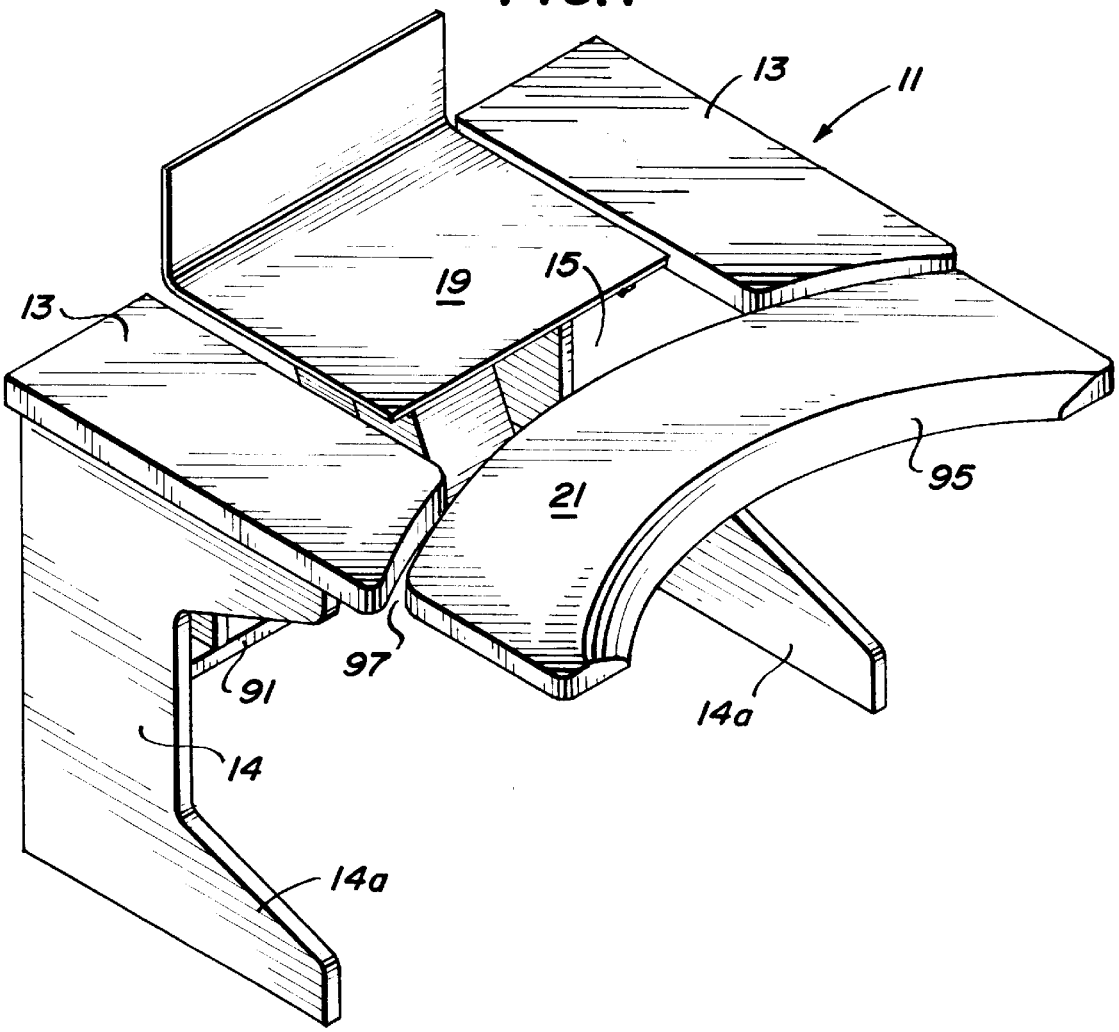
FIG. 1 is an isometric view of the ergonomic workstation of the invention.
Figure 2:
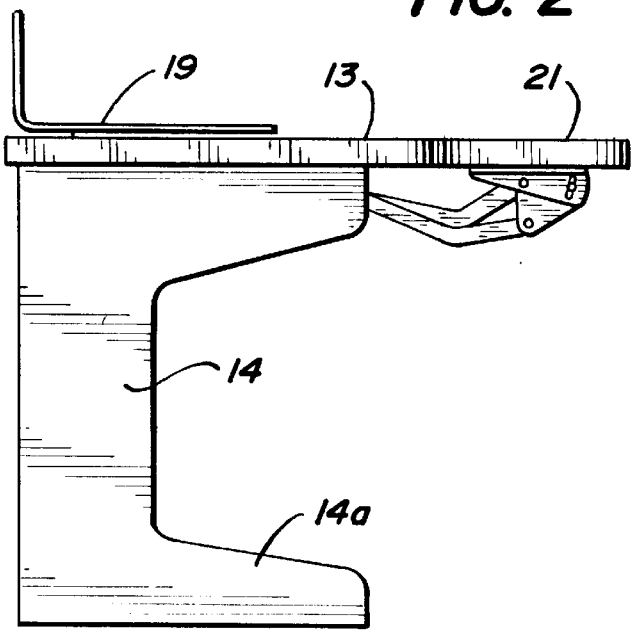
FIG. 2 is a side elevation of the workstation.

The present inventor has discovered that Repetitive Strain Injury (RSI) sometimes referred to as cumulative trauma disorder can be very significantly decreased by providing a workstation designed to adhere to certain requirements for comfort of the operator as well as to allow the operator to periodically adjust the position of the apparatus at fairly short intervals. By the use of such apparatus, assuming the computer operator follows the required method for operating the apparatus in the manner intended, the development of RSI is substantially overcome.

As indicated above, a great deal of thought has been placed by prior workers into the design of computer workstations which it was hoped would decrease Repetitive Strain Injury, or RSI. Such prior inventions have concentrated upon placing the computer operator in a less stressful, more comfortable position, an aim which they have been largely successful in obtaining. However, repetitive stress injuries have continued to occur or have even in some cases accelerated.

The present inventor has found that by replacing the usually partially adjustable computer monitor support and keyboard support or keypad with a combined universally adjustable combination keypad support and monitor support which may be placed in a variety of combined relationships with each other defining essentially different triangular relationships of an infinitely variable triangle whereby the operator periodically changes his or her physical position with respect to both such units RSI can be substantially reduced. The operator in this manner, avoids a large number of serially exact repetitive movements which, as explained above, result in those distressing symptoms and disorders to which computer operators are so prone. In addition, the present invention includes certain refinements of the computer center, or workstation, which are important in eliminating Repetitive Strain Injury. The first of these is the arrangement of the movable support for the video monitor such that the video monitor is maintained always directed along the line of sight of the operator to such video monitor. For example, if the video monitor is at the same level as the eyes of the operator, the video monitor will be maintained level with the work surface, since the line of sight of the operator is parallel to the work surface. On the other hand, if the monitor is moved downwardly so that the line of sight from the operator is downwardly inclined, the monitor face will be upwardly inclined at exactly the reciprocal of the downward inclination of the eyes. The pedestal support for the monitor has been especially designed, therefore, to automatically maintain the video monitor at an inclination which will place it with the face of the video tube perpendicular to the line of sight of the operator to such monitor. Furthermore, if the construction of the system is such that the video monitor can be raised higher than the line of sight of the operator, the support for the monitor will be constructed such that the face of the monitor will still be maintained perpendicular to the line of sight of the operator so that the operator is at all times looking substantially directly at the monitor from his or her seated position.

At the same time, the distance from the monitor to the operator can be readily adjusted by the operator so that it is positioned about at the convergence rest position of the eyes for that particular angle or orientation of the monitor. For example, it has been found by experimentation that the average person's eyes have a resting convergence of the line of sight of both eyes at about thirty-nine (39) inches or a little over one yard when the eyes are horizontal or directed at the horizon. However, as the eyes are directed downwardly at an angle, the resting convergence angle automatically shortens until at about 35° downward inclination, which is about the usual reading angle, the normal resting convergence angle of the two eyes is about twenty-six (26) inches in front of the eye or not much more than two feet. Likewise, if the head is tipped back so that the eyes are directed above horizontal, the resting convergence angle of the eyes tends to lengthen even more. This change in the resting convergence angle of the eyes with the inclination of a viewer's sight is a natural physiological reaction or phenomenon based apparently upon the evolutionary advantage of having the resting convergence of the eyes somewhat near the usual distance of objects when one is looking in that direction. For example, when one is directing their view downwardly, they are frequently examining something held in the hand which brings such object closer to the eye of the viewer. On the other hand, when one is looking parallel to the surface of the earth, one is frequently looking at objects which are fairly close, but not necessarily immediately within reach and somewhat less frequently to objects which are considerable distances away. On the other hand, however, when one looks up into the air, i.e. above the normal horizontal line of sight, one is frequently looking for or viewing something a considerable distance away such as a bird in the sky, something in a tree or the like. It appears from the statistical studies which have shown the resting convergence angles of the eyes tends to increase in the average person as the eye is raised from a low angle to a high angle, that this is a result of evolutionary development in an outdoor environment based upon the average experience through many ages. The resting convergence angle probably also has considerable effect upon the way that we perceive objects.

The resting convergence point of the eyes is essentially the same as the so-called resting point of accommodation, or RPA, and represents essentially that point which the eyes will fixate or focus; upon if they are not attempting to focus upon something at another point and represents the point in front of the eyes at which a minimum eye accommodation effort will be expended if a viewed object is located at such point. In addition, it has been found that the pixel-based display of a video tube has a distribution of light amplitudes essentially of a so-called Gaussian nature in which the center of the field is most bright and fades to less bright along the edges. Gaussian images tend to be inherently out of focus because of lack of good figure-ground contrast, the indistinctness of the edges and spatial frequency cues for accurate focus are few or entirely lacking. In such conditions, the eye tends to react as it would in a featureless field with the focus tending to shift to the resting point of accommodation, or RPA. However, if the video terminal is not actually at the RPA, the eye accommodation then tends to rapidly shift back and forth between the RPA, or resting point of accommodation, and the actual face of the monitor, resulting in rapidly tiring eye accommodation muscles and eye strain.

In order to increase the ease of using a computer workstation, it has been found that it is advantageous to try and set the distance of the video monitor at about the average resting convergence point or resting point of accommodation of the eyes of the average person or more particularly that of the actual operator. Consequently, it has been found that as the video monitor is moved in order to change the attitude of the operator during use of the video terminals, the distance of the video monitor should also be changed so that when the gaze of the viewer is inclined downwardly, the video monitor is closer to the viewer, while when the video monitor is brought up to about eye level, such video monitor should be distanced from the viewer about thirty-nine (39) inches or just over one yard. In some cases, in addition, it may be advantageous to bring the video monitor above a horizontal line of sight, since this is sometimes a restful position, particularly after a full day of having viewed the monitor at other positions and angles. There is one difficulty, however, and that is that as the video monitor is raised, the convergence angle of the eyes extends beyond thirty-nine (39) inches and begins to become so far removed that if one is to place the video monitor at such distance, the information on the monitor must be magnified or use larger letters or characters to increase the visibility of the material on the screen so that the operator may have good visual discrimination of information on the screen. Consequently, while it may be advantageous with respect to preventing RSI to change the angle and position of the monitor along the line of sight into an upper or upward quadrant, the lessening of visual acuity with respect to information displayed on the monitor and the resultant necessity to enlarge the reference characters or other material on the monitor for visual accuracy may counteract any advantage in actually raising a monitor beyond a level position with the eye. However, some operators may find an occasional higher level of viewing to be effective in combatting RSI and for these operators it may be desirable to provide the capability of raising the level of the monitor.

As indicated above, it has been found by the present inventor that much of the Repetitive Strain Injury associated with long continued use of computer workstations may be eliminated by merely facilitating periodic change on a fairly short term basis of the operator's position and viewing angle so that the normal long term repetition of movements is decreased and the various movements of the operator are not complete repetitions, but instead are continuously varied generalized repetitions of movements which are much less likely to result in cumulative trauma disorders of the skeletal muscle system than closely identical repetitions of the same movements.

As is well known, it has been the custom in the past to provide adjustable seating for office workers, and particularly for typists and computer operators and the like so that the operator may assume the most comfortable seated position. Unfortunately, it has been found that the seated party, once they have adjusted the chair to their liking, will as a practical matter, never readjust the chair, no matter how uncomfortable it may become. The most that such a party is likely to do, in fact, is, if the chair is tilting, to lean back in it, which does at least change the broad attitude of the seated party, but is not very useful if one must operate a keyboard. However, no matter how easy an adjustment of a chair is made, as a practical matter, such adjustment is made only at the beginning of use of the chair by any given person. To some extent, this is probably caused by the fact that in most chairs it is necessary to get out of the chair and to make fairly complicated movements to adjust such chair. However, even where the chair is power operated, for example, by push buttons or the like and can be moved by the seated party while seated, once a comfortable position for the user of the chair is found, it is very seldom that such person ever readjusts the chair, even where this can be done by push button power means or other expedients while seated in the chair. As a practical matter, therefore, the adjustability of the seating arrangements with respect to computer monitors, while advantageous in improving the comfort of the operator, and even in improving the initial efficiency of the positioning of the operator, is not effective in changing the physical alignment of the body of the operator during an operating period before a video monitor for a computer.

For the same reason, most of the adjustable workstations developed in the past, and even those so-called ergonomically designed workstations have not been overly effective in preventing Repetitive Strain Injury, or RSI, due to the fact that adjustments are not easily made during operation of the computer and as a consequence, are very seldom, if ever made once an initial setup is adjusted for a particular operator. In addition, even in those prior workstations where the operator has been able to fairly easily move one component of the workstation, such as, for example, the keyboard, which, being often connected to a freely movable cable, may even sometimes be lifted from the keyboard pad and held in the operator's lap, both of the main components of the operator's station, i.e. the keyboard and the video monitor, have not been easily adjustable and, therefore, the triangulation between the eye of the operator, the monitor screen and the keyboard has not been universally adjustable within predetermined limits, but only partially adjustable. For example, in many adjustable computer workstations or computer workstations having one or more adjustable components, such components, after adjustment, are required to be jam locked into place, usually by turning a jam-type adjustment knob or the like. Such adjustments take so much time to effect that, as a practical matter, just as in the adjustment of a chair, further adjustments are never made subsequent to the initial adjustment.

In the applicant's arrangement of a computer workstation, on the other hand, the monitor position is made universally adjustable within predetermined limits both in an up-and-down direction and in a back-and-forth direction and in addition, the monitor is made to pivot automatically so that the face of the monitor is always perpendicular to the line of sight of the observer. A mechanical arrangement, usually embodying an easily moved slide arrangement also allows the video monitor position to be changed with respect particularly to its distance from the operator so that particularly as the monitor is moved downwardly, inclining in coordination with such movement, it may also be moved closer to the operator so that it is more closely adjusted to the resting convergence angle of the eye. Likewise, as the computer monitor is brought upwardly, raising the sight of the operator upon such monitor, the monitor may be moved away from the operator so that it continues to conform to the average resting convergence point of the eye bringing the monitor from a position of 35° declination where it should be about twenty-six (26) inches from the eye of the observer to an angle of 90°, or horizontal with the observer's eye, where it should be at about thirty-nine (39) inches from the observer's eye, indicates that the forward and backward slide movement of the computer should be about twelve (13) inches at minimum.

As indicated above, it is of critical importance that the movement of the monitor as well as the keyboard pad be so easily accomplished that it can, in effect, be accomplished with mere finger motion and does not require any significant force. Consequently, it is of critical importance that the monitor in particular be well balanced, or counterbalanced so that the operator does not have to exert any great strength to move the monitor, yet the monitor once positioned will hold such position until deliberately moved again by the operator to change the operator's position with respect to the apparatus and prevent repetitive strain injury or syndrome.

The video monitor as well as the keypad could be moved by power means and controlled by push button or lever type controls moved by the operator. However, it has been found more preferable for the monitor and the keypad to be accurately counterbalanced and for the operator to directly move these units since manual movement and adjustment can usually be accomplished more quickly and with less interruption of the task at hand than power movement, largely because of the overshoot and searching which is so frequently a problem with power systems, particularly where the speed of movement is high. Thus a manual adjustment is much more likely to be actually done and the manual movement of the arms to move the monitor in particular is in itself an aid in breaking up a long continued repetitive movement.

It has been found that in order to effectively prevent RSI the monitor should have a minimum movement of about at least twelve inches and preferably sixteen inches and even more preferably twenty inches to the highest elevation and for best results should have a movement at least equal to one diameter of the monitor screen itself, which of course may be variable. The monitor should also be moveable with a forward and backward motion in the horizontal direction of at least the length of the long side of a right triangle having a hypotenuse of thirteen inches in length and preferably be at least as long as the length of the long side of a triangle having a hypotenuse of fifteen inches in length.

The keypad is preferably adjustable in a vertical direction at least twelve inches and more preferably still sixteen inches and can be inclined preferably nine degrees toward the operator and fifteen degrees away from the operator.

In FIG. 1, there is shown an isometric view of a workstation in accordance with the invention including a workstation structure 11 in the form generally of a piece of furniture comprising a top 13 having a central opening 15 in which a video monitor 17 (see FIG. 3) and monitor support 19 are positioned. A side panel 14 closes and completes the side of the workstation while leg extensions 14*a* maintain the workstation stable. A keyboard pad, or keypad, 21 is mounted at the front of the workstation in a position where it is easily accessible to the operator. A keyboard 23 (see FIGS. 6 and 7) may be positioned in the center of the keyboard pad 21 preferably in a slight depression (not shown) in the keyboard pad which will prevent the keyboard from sliding off the pad when such pad is set at an angle. The depression is not necessary in most cases, however, unless the angle of the pad is very steep, since the usual rubber feet on the keyboard will normally keep it in place upon the keypad.

Figure 3:
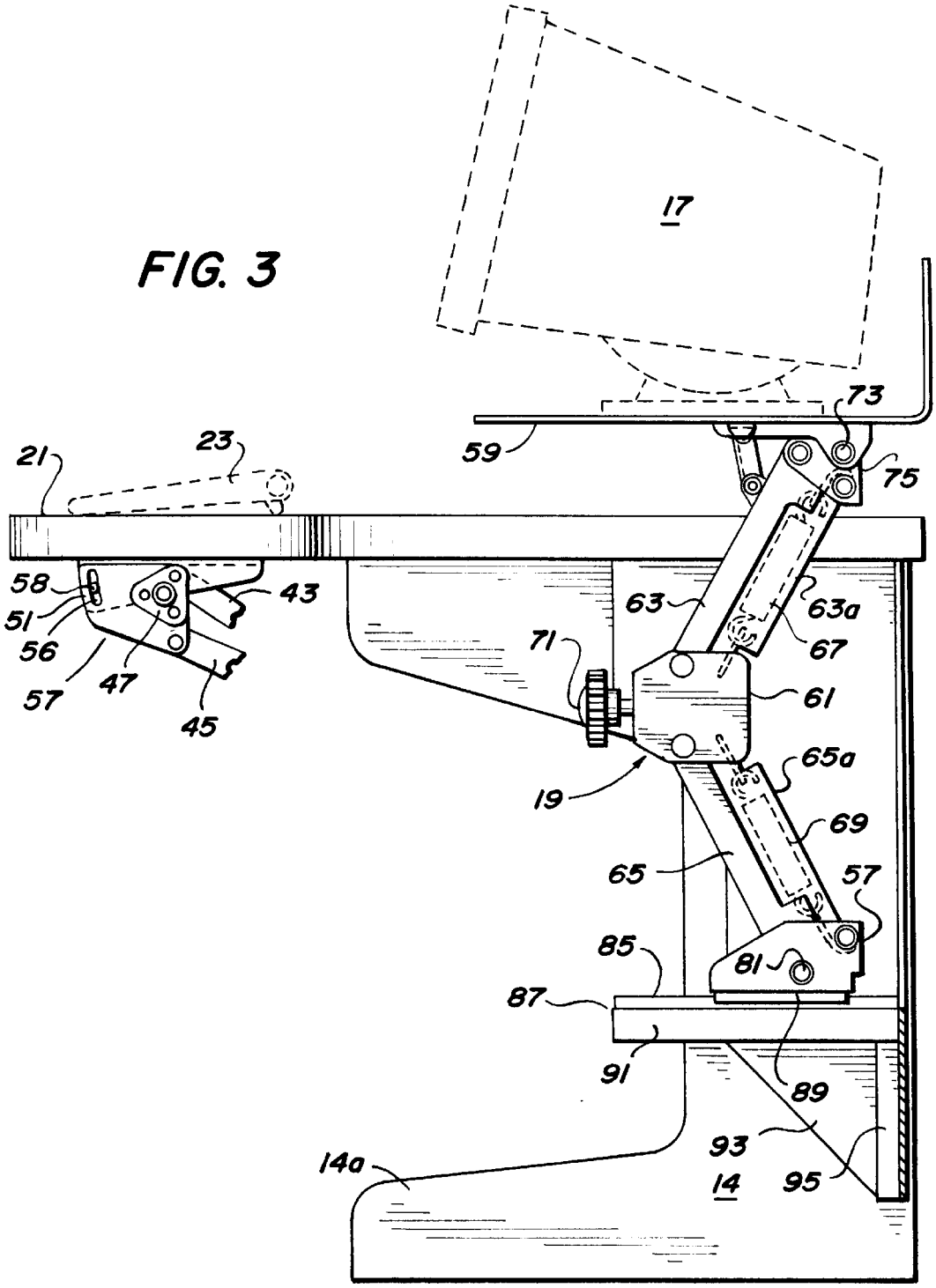
FIG. 3 is a side elevation of a section through the workstation of the invention showing in phantom a computer video display terminal supported upon an adjustable support arm.
Figure 4:
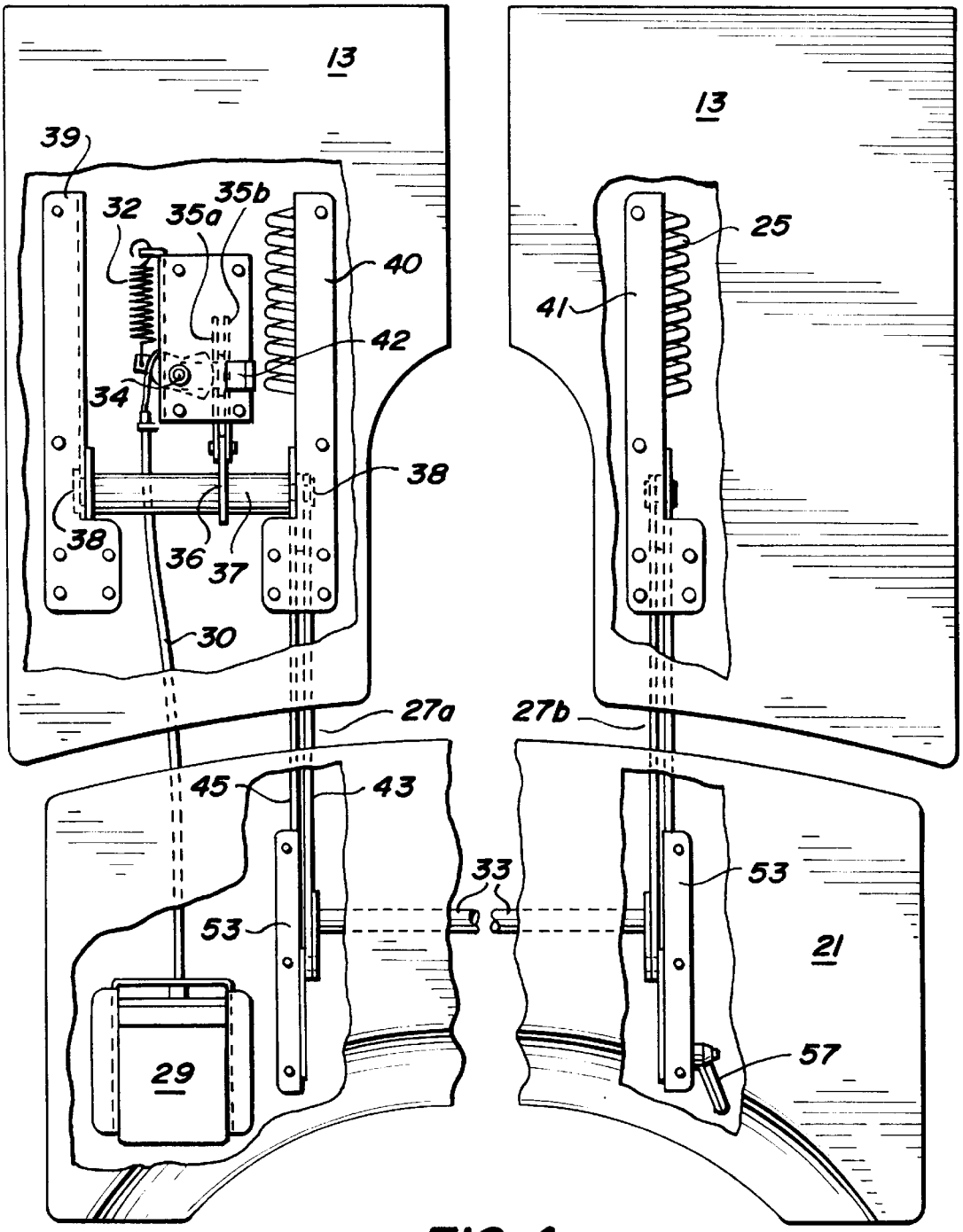
FIG. 4 is a partially broken away plan view of the computer workstation of the invention.

The keypad 21 is mounted upon adjustable compound support arms 27 which are better seen in FIGS. 3 and 4. Such adjustable arms 27 are formed from several pivoted parts, described hereinafter, and are spring counterbalanced. The keyboard pad member 21 is attached to the adjustable compound support arms in any suitable manner and the movement of such arms is coordinated preferably by a crossbar 33 which passes between the two supporting arms 27. Such crossbar not only coordinates the movement of the adjustable supporting arms 27, but also strengthens the entire structure, preventing the keypad from being twisted while moving. It will be understood that the adjustable support arms are counterbalanced by spring tension provided by springs 25, which spring tension is matched against the weight of the keyboard on the keyboard pad so that the keyboard 23 as well as the pad 21 itself can easily be moved in a known manner with a minimum of effort by the operator. Since the operator does exert force upon the keyboard during operation thereof, although such required force should be a minimum, it is desirable that the keypad be locked in place during operation, since it will not only have to support its own weight or be counterbalanced against its own weight, but also support the weight of a hand resting on the lower or outside portion of the keyboard pad as well, and, as indicated, also the pressure exerted upon the keyboard in punching the keys. A locking arrangement is, therefore, also provided which, while it allows the keypad to be raised by mere finger contact at any time, a single squeeze control lock 29 must be deactivated before the keypad and keyboard can be lowered. This is necessary to enable the keypad and keyboard itself to be worked upon without being pressed downwardly. The keypad is preferably designed to support four hundred eighty pounds without movement or collapse so long as the lock is not disengaged. In the case shown, an adjustable squeeze lock 29 of a type known in the art is mounted under the keyboard pad 21 and may be operated by a simple thumb and finger squeezing or pressing of the lock elements to place it in unlocked position or condition. Such lock may be very easily disengaged whenever the operator wishes to move the keyboard pad so that the lock presents very little impediment to the operator with respect to moving the keyboard pad to encourage the operator to make periodic adjustments or movements and, therefore, cut down repetitive movements which may result in RSI injury to the operator over a long period.

The keypad 21 may be moved on its adjustable counterbalanced arms 27 up and down, the up movement being preferably at least about seven (7) inches above the nominal top 13 of the work surface of the work station and five and three quarters (5.75) inches below the surface tops or, in other words, a total up and down travel distance of twelve and three-quarters (12.75) inches. As indicated above, the supporting structure is also provided with a downward movement lock which is effective to lock the keypad structure against downward movement up to a weight or force exerted downwardly against it of preferably at least four hundred and eighty pounds. The squeeze lock 29, which is mounted upon the bottom of the keypad 21, is attached by a locking cable 30 to a mounting 31 secured to the underside of the work surface 13 of the workstation 11. A spring 32 normally urges a pivoted cam 34 in a slot against the side of one of two slide members 35*a* and 35*b*, both attached to a crank arrangement 36 upon a rotatable bar 37 pivoted or journaled in two mountings 38 held by brackets 39 and 40 also secured to the underside of the work surface 13, the bracket 40, also serving along with a third bracket 41 to support the end of the support arms 27 upon the underside of the work surfaces 13.

The slide members 35 pass through slots in a bar or other openings in a guide member 42 secured upon the mounting 31 and the cam 34 extends from the side against the near slide member 35a which tends to become jammed by the spring biased cam 34 preventing movement of the slide member 35*a* toward the rotatable bar 37 and the attachment of the crank 36 to the bar 37 preventing the bar 37 from rotating and thus preventing the rotatable compound arms 27, the left one of which 27*a* is directly attached to the bar 37, while the right one of which 27*b*, is in turn connected to the rotatable arm 27*a* through the tie bar 33, which, rather than extending as an extension of rotatable bar or rod 37 between the two arms to tie them together, extends between the two arms 27*a* and 27*b* at the outer portion of the arms 27*a* and 27*b* where it not only ties the two arms together, but also prevents twisting of the keypad and also leaves the area in the central well or opening 15 of the workstation free of any obstruction that would prevent free movement of the monitor support forwardly towards the operator in the opening of the workstation. The guide member or bar 42 may either have two slots in it through which the two slide members 35 pass, in which case only the near one 35*a* will act as a tension member while the other acts as a balancing member for the crank 36. However, in an alternative arrangement, there may be only one slot through which both slide members pass with a solid, but movable pad between the two through which clamping pressure is applied to both by the cam 34.

The supporting arms 27*a* and 27*b* for the keypad 21 are each made in the form of two parallel arms 43 and 45 shown in FIGS. 3 and 4 attached by rotating stretcher bars 47 located below the keypad 21 and stretcher bars 49 located under the work surface 13 on both sides of the workstation. The stretcher bars 47 and 49 are attached in the front under the keypad 21 to the ends of the bar 33 and in the rear under the work surfaces 13 on one side to the bar 37 and on both sides to springs 25 which serve to support the compound arms 27*a* and 27*b* against the weight of the keypad and anything placed upon the keypad, such as the keyboard plus a mouse pad or the like, if used. The compound parallel form of the arms 27 formed from the individual arms 43 and 45 pivoted at the ends to the stretcher bars 47 and 49 enables the keypad to maintain a given orientation to a level plane or supporting structure upon which the entire workstation rests. In addition, a bracket 51 to which the keypad 21 is directly attached and which may be an extension of a mounting 53 to which the keypad is attached, may be rotated with respect to the stretcher member to which the two arms 43 and 45 may be attached allowing the keypad 21 to be inclined backward and forward with respect to the supporting structure or other level surface. Such rotation of the bracket 51 and stretcher member 47 with respect to each other allows inclination of the keypad 21 which is normally prevented by a jam lock 55 which pulls the two against each other in a jam or friction relationship which holds the keypad in whatever position it is set. The lock, as shown, has a handle 57 to exert leverage upon the jam lock which comprises essentially a screw thread-type device including a curved groove 56 which rotates past a threaded member 58 as seen in FIG. 3.

As indicated above, in addition to its upward and downward range of movements, the keyboard is so mounted that it may be inclined to tilted position toward the operator of preferably nine degrees (9°) from horizontal or fifteen (15°) away from the operator. The keypad need not be made moveable toward and away from the operator since, as will presently be seen the video monitor support 19 is movable toward and away from the operator so that the two can be brought to essentially abutment with each other or even in some cases the video monitor can be overlapped with the keyboard, i.e. extend partially above the keyboard or supporting keypad. The movement of the monitor therefore provides a combined movement of the keyboard and monitor toward and away from each other to vary the shape and dimensions of an infinitely adjustable triangle between the keyboard, the monitor and the eye of the operator.

The infinitely adjustable triangle may be imagined to be traced out upon a vertical plane passing through the center of the video monitor support 19 as well as the operator, essentially bisecting both the monitor support and the operator or the entire workstation. The triangle between the monitor, the keyboard and the eye of the operator is characterized by being infinitely adjustable within its maximum dimensions so that it may take any shape with any side dimensions within the maximum dimensions as provided by the maximum forward and vertical movement of the monitor support and the maximum vertical movement of the keypad as modified by the inclination, of the keyboard or keypad. The keypad is not normally movable in the forward or back directions because of the horizontal range of movement of the monitor support, since the horizontal movement of the one structure is sufficient to define the length of the infinitely variable triangle. However, this is not to say that the keypad could not be made adjustable in a horizontal direction, but only that such further adjustability is not normally necessary.

Figure 6:
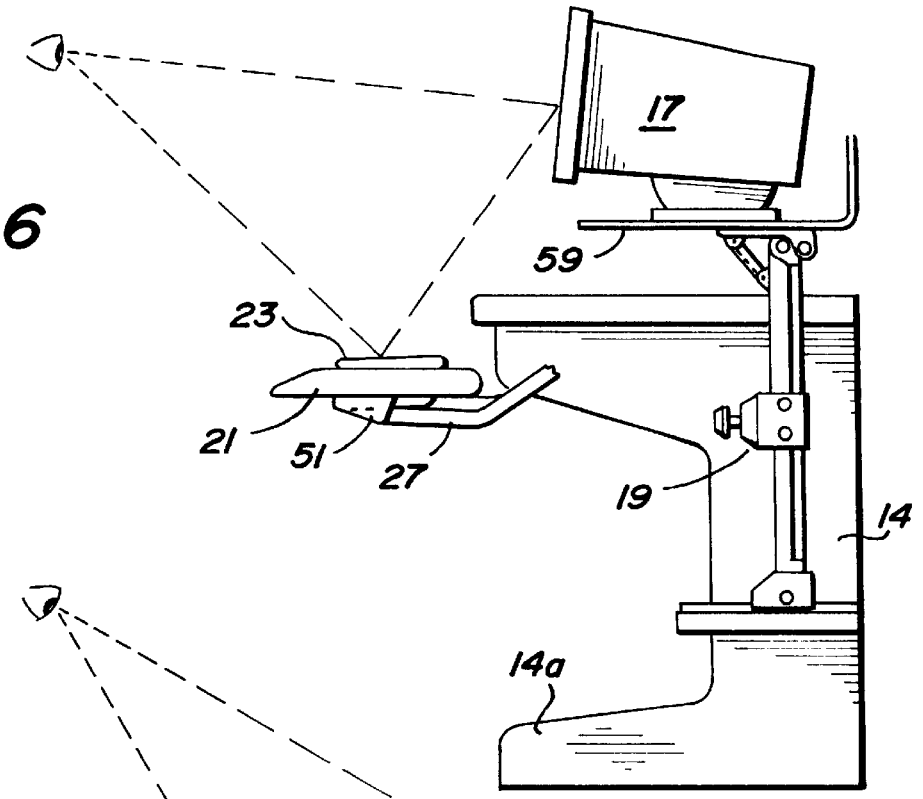
FIG. 6 is a diagrammatic side view of the apparatus of the invention with one side removed and showing one possible relationship of the components of the invention.
Figure 7:
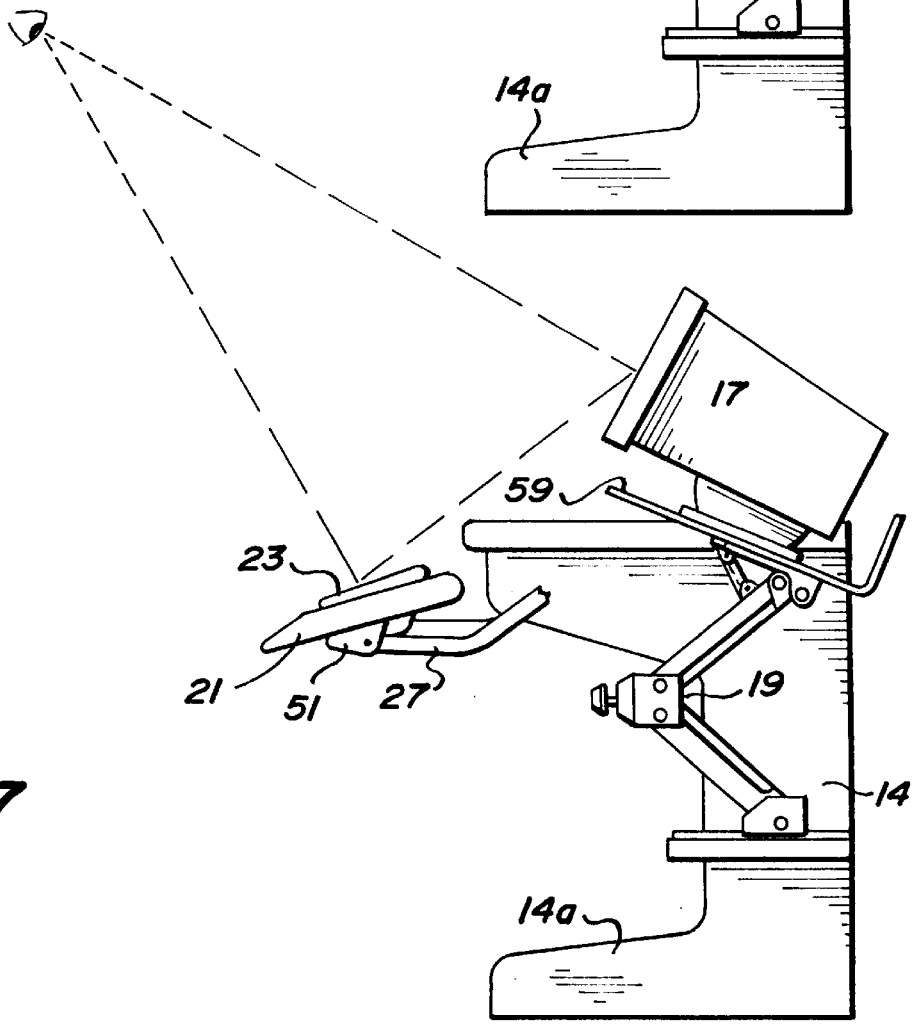
FIG. 7 is a diagrammatic side view of the apparatus similar to FIG. 6 showing a further possible relationship of the components of the invention.

The adjustable monitor support means 19 upon which the video monitor 17 is mounted comprises, as best shown in FIG. 3, four principal parts, namely a base 57, an upper video carrier 59, a central adjustable knee piece 61 or central pivot mounting plus two (2) articulated legs 63 and 65, articulated leg 63 being the upper articulated leg member and the articulated leg 65 being the lower leg member. As shown in FIG. 3, the articulated legs 63 and 65 have internal springs 67 and 69, respectively. The central pivot mounting 61 provides a knee point where the two (2) articulated legs 63 and 65 pivot. It also incorporates an adjustment knob 71 which by moving the internal attachment points at which the springs 67 and 69 are attached internally to the knee structure determines the amount of tension in the springs and therefore, the amount of weight that will be exactly counterbalanced by the mechanism. It will be understood that the base 57 and the video carrier 59 are pivoted to the bottom and the top respectively of the monitor support legs 65 and 63. At the top of the upper articulated leg 63 is a pivot 73 upon which the video carrier 59 may move. This pivot point is interengaged with a cap piece 75 which is in turn pivoted at one end to the top of the upper articulated leg 63 by a pivot 77. A second pivot 79 mounts a cover plate 63*a* which is loosely inserted into the central adjustable knee member 61 and essentially serves to cover the spring 67 which is connected to the same pivot 79. Likewise, a pivot 81 pivotally connects the lower articulated arm 65 to the base 57 and a second pivot 82 mounts the end of the spring 69 as well as holds a cover plate 65*a* over the spring 69, the other or top end of the cover plate 65*a* sliding into the central knee piece. The springs 67 and 69, it will be understood, are attached within the central knee piece 61 to a conventional mechanism, not shown, such that the attached points of the springs 67 and 69 can be varied by means of the adjustment knob 71 so that the tension in the two springs can be varied and the two can, therefore, exert more or less force upon the central knee to tend to pull it inwardly with respect to the legs 63 and 65 so there is tendency to bring the legs 63 and 65 into a more or less paralleled orientation such as shown in FIG. 6, for example, when the connection point of the springs are moved farther apart, however, in effect lessening the tension in the springs 67 and 69 to adjust for a lighter monitor. The spring counterbalanced movement allows the legs 63 and 65 to be placed in any position within their range of motion once adjusted for counter-balancing force and to retain such position until moved again. For example, the legs 63 and 65 can take more or less of a position such as shown in FIG. 7 where the legs 63 and 65 are held with respect to each other with the same weight at a lower position with the legs at an acute angle to each other. The interconnection, not shown, of the springs 67 and 69 with an adjustment mechanism controlled by knob 71 can take several forms, including a basic rocking arm mechanical arrangement or a screw operated scissors-type mechanism. Various other mechanisms similar to this can be obtained and have the advantage not only of differential weight support, but also provide an arrangement by which the bottom or base and the top or carrier 59 are kept parallel, while the arms change their inclination with each other.

The video carrier 59 is also attached to the upper leg 49 by means of an inclination arm 83 which is so articulated between the video support 59 and the upper articulated leg 63 that as the legs 63 and 65 are folded towards each other lowering the video carrier and monitor 17, the inclination arm 83 is extended or pivoted upwardly because of its pivoting on the support or video carrier 59 and in effect, therefore, pivots the video carrier 59 to an angle with the arms or legs 63 and 65 which ensures that the angle of the video carrier 59 and the video 17 carried become steeper, the angle of the video support 59 of the inclination having been calculated to be about 35° from the horizontal when the two articulated legs 63 and 65 are folded more or less tightly against each other. This will effectively bring the video carrier 59 to a substantially horizontal position when the two articulated legs 63 and 64 are brought into a substantially, but not quite, parallel relationship at their highest point. This assures that the video monitor is retained so that its front screen is more or less perpendicular to the line of sight of the operator at all times, thus increasing its ease of viewability and allowing the face of the monitor to always be directly in the line of sight of the operator at the same time as it is preferably maintained at the resting accommodation point of the eyes of the operator.

As shown best in FIGS. 3, 6 and 7, the base 57 of the video support 19 is mounted upon a slide arrangement 85 so that it may be moved toward or away from the operator. As explained above, the length of the slide or track 87 should be at least about twelve (12) inches if the maximum upward position of the video monitor is substantially horizontal with the line of sight. However, if the maximum upward position of the monitor support 19 brings the monitor 17 substantially beyond or above the line of sight of the operator, i.e. above or higher than the horizontal line of sight, then the track 87 should be longer than twelve (12) inches. As indicated above, while having the monitor higher than the normal horizontal line of sight may be advantageous in some cases, this is not always true, since, with the longer resting convergence point of the eyes, the video monitor should ideally be moved farther from the operator's eyes so that the disadvantage of perhaps having to have larger characters such as letters, numbers or alphanumeric figures upon the screen, which means basically that less material can be gotten on the screen at one time, may be sufficiently more of a detriment than being able to have the further or greater adjustability of the position of the monitor in order to rest the operator's skeletal musculature system and decrease or eliminate Repetitive Stress Injury, which may, in any event, be rather thoroughly decreased or even eliminated by having an adjustment of the apparatus from about 35° up to substantially 90° or horizontal with the view of the observer.

The track or slide 87 may desirably be in the form of a basic flat surface having extended edges over which a flange 89 may fit to hold the base 57 to the track 87. Stops, not shown, may be used to retain the base 57 on the track 87. The track 87 is preferably mounted, as shown in FIG. 3, on a shelf 91, which extends across the entire back of the workstation at a distance above the floor or base surface upon which the workstation is supported. This shelf 91 is strengthened by triangular brackets 93 extending from the back 95 of the workstation. As best seen in FIG. 1, an inside surface of the workstation itself extending downwardly from the work surfaces 13 and attached to the top of the shelf 91 provides additional stiffness to shelf 91 and provides storage dividers on the shelf for operation manuals or the like.

It should be noted that the outside edge 95 of the keypad 21 is tapered and smoothly rounded so as not to extend even for a short time into the operator's flesh in the wrist or lower arm region and so that the keypad 21 has a significant clearance 97 between the back of the keypad 21 and the adjacent work surfaces 13 so that no pinch points are created in which the operator's fingers could be pinched during movement of the keypad. Such significant clearance between the keypad 21 and the remainder of the apparatus should be at least the thickness of a large man's fingers or not less than about three-quarters of an inch to one inch for safety reasons. The clearance 97 is clearly shown in FIG. 5 which is a plan view of the apparatus.

During operation of the device of the invention, the operator will initially adjust the keyboard and the monitor to a height and a relative distance from the operator and each other which is comfortable to the operator. Such adjustment of distance and height can be accomplished solely with hand pressure or force and literally only with two (2) fingers. The operator then, after operating the computer in such position for a fairly short period, will either deliberately change the position on a formal or informal schedule to another comfortable feeling position or will do so after he or she becomes somewhat tired of the first position. Because of the delicate counterbalancing of both the video monitor and the keypad, movement of these structures can literally be accomplished by two (2) fingers with only a few pounds of force applied. The aim is literally to have the movable or adjustable parts so easily movable that they can be moved almost with the thought of moving, with the fingers acting almost as a direct extension of the brain. Instructions for operation to the operator may well be essentially as follows: "Think where you want the monitor and at the same time effortlessly using your finger tips as an extension of your mind, place the monitor quickly where it is desired." With a minimum of practice, the operator will be able to make adjustments to change his or her position almost automatically every time a minor degree of discomfort is detected.

FIGS. 6 and 7 are diagrammatic side views of the workstation of the invention similar to FIG. 3, but showing the component of the workstation in two (2) different configurations and illustrating in dotted lines a variation of the ergonomic infinitely variable triangle between the operator's eye, the video monitor 17 and the keyboard 23 upon the keypad 21. It will be noted that in FIGS. 3, 6 and 7, the monitor has a somewhat inclined base which slightly elevates the face toward the angle of they eye a slight amount even at maximum extension of the monitor support 19. Horizontal bases on the monitor can also be used, however.

As indicated above, it may at times be desirable to have the monitor support 19 extend above the horizontal viewing plane and in such instance, the monitor screen will be angled down toward the operator's eye. In addition, it may in some instances in a deluxe installation, be desired to provide means for pre-adjusting the height of the support arm to allow for different height seated operators. In this instance, the length of the two articulated arms 63 and 65 may be mechanically adjusted or changed at the beginning of operation by that particular operator to obtain an exact alignment of the monitor horizontally with the eye of the operator at the start of operations after which the operator may periodically change the position of the monitor and keypad as he or she feels the need for a change.

Figure 8:
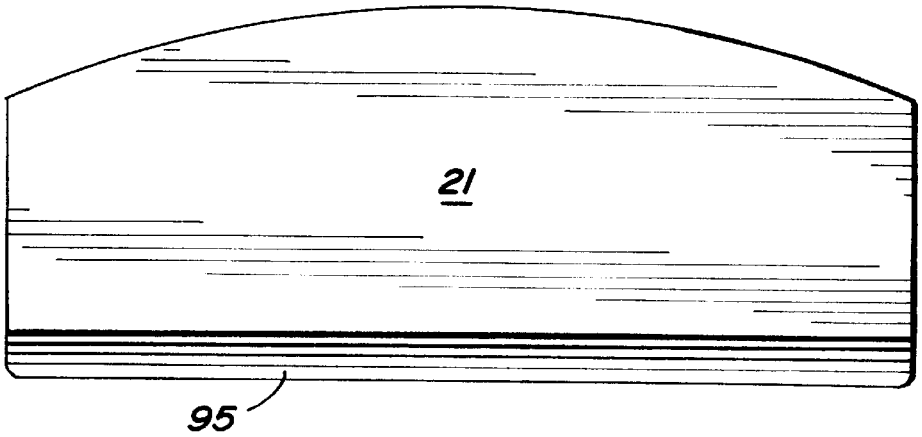
FIG. 8 is a plan view of an alternative shaped keypad for the workstation providing expanded work surface.

In FIG. 8 there is shown an extra or alternative keyboard pad for attachment of the two (2) adjustable arms 27, particularly when more working space is desired on the keyboard pad. The type of keyboard pad shown in FIGS. 1 and 5 includes a cutout portion on the front which is both more pleasing from an artistic viewpoint and may, in some cases, allow the computer operator to get closer to the keyboard pad. However, the keypad shown in FIG. 8 has more working room or area and may be especially desirable when a mouse and mouse pad are being used. The inclination of the mouse pad, along with the entire keypad so the keyboard and the mouse pad are always in line, aids in the elimination of so-called "mouse-hand".

FIG. 7 shows a workstation in accordance with that shown in the previous views integrated into a modular office plan along one of the long sides of the room in which the modular components are contained. The remainder of the working space within the modular plan remains the same and the section where the computer workstation goes is merely removed so that said computer workstation which may be mounted upon suitable rollers or wheels, not shown, may be rolled right into the opening in the modular plan.

Figure 5:
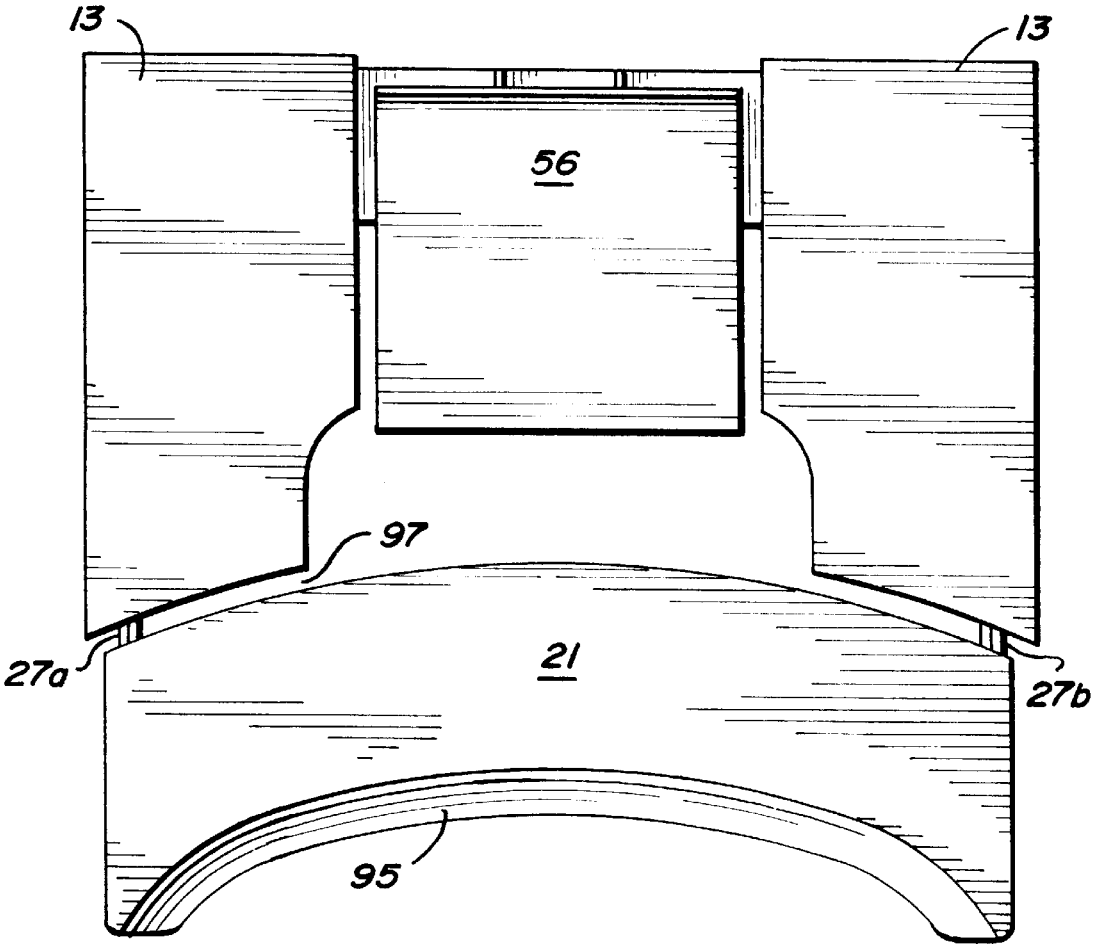
FIG. 5 is a plan view of the workstation showing both the computer monitor support and the keypad support in one normal relationship.
Figure 9:
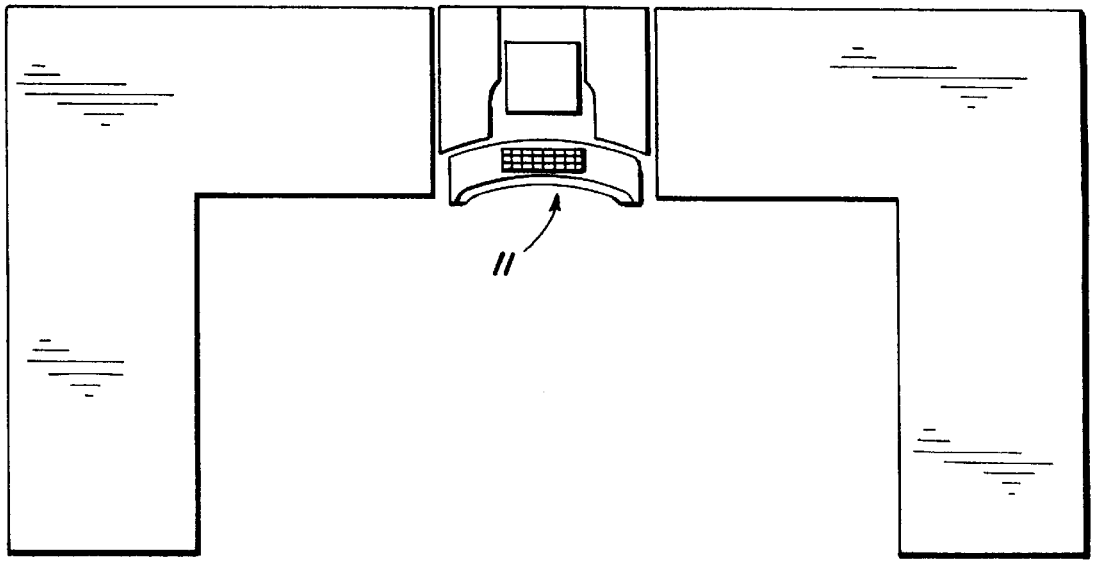
FIG. 9 is a plan view of the workstation of the invention incorporate into a unitary cubicle-type office plan.
Figure 10:
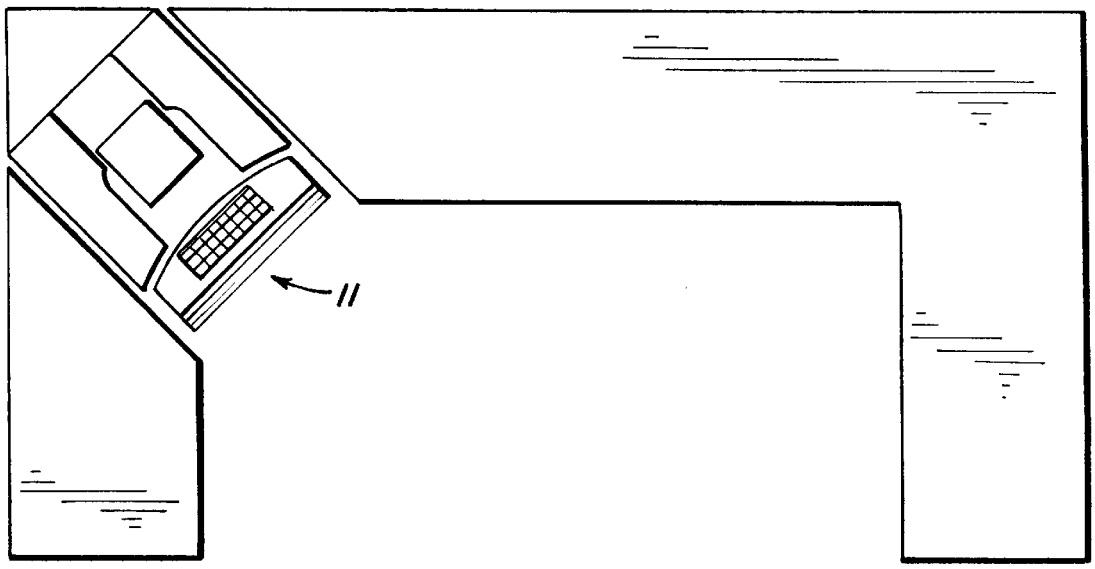
FIG. 10 is a plan view of the workstation of the invention incorporated into a corner position in a unitary cubicle-type office plan.

FIG. 10 shows a further incorporation of a computer workstation in accordance with the invention and is shown in the previous views, wherein the workstation is incorporated into the modular plan at one corner in order to give a somewhat variable look and in some cases, to provide a more flexible modular plan which may be more efficient and pleasing to some office users. The plan shown in FIG. 10 is more likely to be used by a higher level executive than the plan shown in FIG. 9 which may be more likely used by a lower level executive. It will be understood that the free-standing workstation essentially as shown in FIGS. 1 and 5, for example, will usually be used for a full fledged computer operator.

FIG. 11 shows in plan view an alternative embodiment of the invention in which the workstation is incorporated into an office arrangement in one corner as in FIG. 10, but in a separate unit. The same reference numerals are used as in the previous views to identify various structures.

FIG. 12 shows in plan view a somewhat different embodiment similar to that shown in FIG. 11, but incorporating a larger or super-sized keypad or keyboard support 21*a*, similar structures being marked with similar reference numerals as in prior views.

FIG. 13 is a plan view of a still further embodiment of the invention in which two video monitors 17*a* and 17*b* are incorporated in a single workstation having a single keypad or keyboard support shown with two keyboards for the two monitors. It will be understood that the two monitors may be supported upon two separate video monitor supports or alternatively a double video monitor support as shown more particularly in FIG. 15 hereinafter. The same reference numerals are used to identify similar structures in FIG. 15 as are used in FIG. 3 in particular as the adjustable support arm shown in FIG. 15 is basically similar to that shown in FIG. 3.

In many commercial installations used at the present time, extra large video monitors are used in order to display a large amount of data at a time in larger type form, for example, in a large spreadsheet or the like which has to be displayed in readable form and is often convenient to display in as complete form as possible at one time. These large monitors are appropriately heavy and may be beyond the ready capacity of a single adjustable arm such as shown in FIG. 3. If too much weight is placed upon an arm, its ready adjustability may be interfered with or it may merely sink downwardly upon being adjusted rather than supporting the monitor easily in any position to which it is set. To get around this difficulty and gain the capacity to adjustably support monitors of almost any size, the present inventor has found that two of the adjustable arms of the invention can be very effectively ganged together to attain additional capacity by attaching the two arms securely at the top and the bottom so that a mere touch upon the monitor base or any other portion of the apparatus will be sufficient to move the monitor to any desired position. The same reference numerals are used in FIG. 15 as in FIG. 14 to identify similar parts, except that those parts identified in FIG. 14 with certain reference numerals are identified in FIG. 15 with alphanumeric versions of the same reference numerals. However, in the case of one adjustable support, the supplementary designations "a" (see the left adjustable support arm) and the designation "b" in the case of the other adjustable support arm, are used to form alphanumeric designations.

Figure 16:
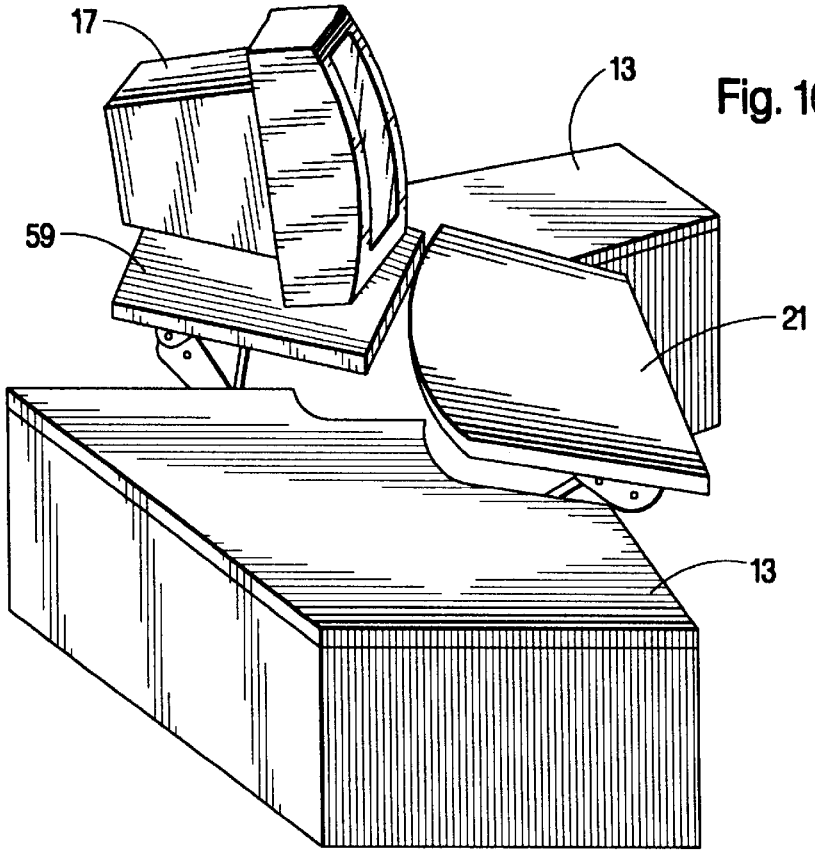
FIG. 16 is a partial isometric top side view of an arrangement of a workstation in accordance with the invention showing one position of the video monitor and keypad support.
Figure 17:
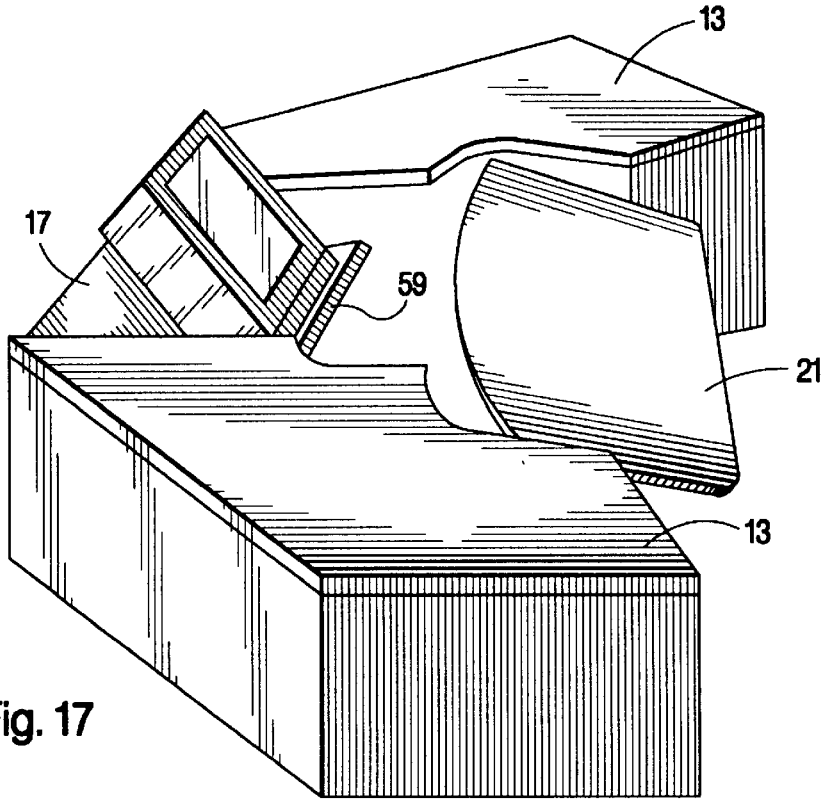
FIG. 17 is a partial isometric top side view of the workstation shown in FIG. 16 showing a different adjustment of the video monitor and keypad support.

FIG. 16 shows an isometric upper side view of an embodiment of the invention such as shown in plan view in FIG. 12 with the large keypad or keyboard support and both the video monitor and the keypad adjusted to one angle while FIG. 17 shows a similar isometric upper side view of the same workstation as in FIG. 16 with the video monitor and keypad in different orientations as a result of a different adjustment of both the monitor support and the keypad support.

As indicated, the force necessary to move both the video monitor support and the keypad should not exceed a maximum so that the operator is encouraged to make the necessary changes in position. In general, it has been found that the force necessary should not be greater than about eight (8) pounds of force and more preferably, not greater than six (6) pounds for the monitor or even more preferably four (4) pounds for the monitor and three (3) pounds for the keypad.

It should be recognized that while certain means and mechanisms have been shown and described to effect the present invention, that other comparable function apparatus and mechanisms could also be used. For example, while spring counterbalanced apparatus has been shown and is preferred to support the monitor and the keypad so such monitor and keypad can be moved with a minimum force which will not inhibit the operator from moving them, such counterbalancing could be effected in other ways and with other apparatus, for example, by gas cylinder type apparatus, by weight counterbalancing and even by computer controlled powered movements in which the force applied by the operator to move, for example, the monitor is automatically followed by the mechanical or other power system, i.e. a power assist system making the adjustment of the parts even more easily adjustable at will.

It will be recognized from the above, that the present inventor has provided an extremely efficient and effective computer workstation from an ergonomic viewpoint which allows the operator at such station to infinitely vary the position of the computer, video monitor and the keyboard with respect to the operator to very significantly diminish or even completely eliminate any chance of Repetitive Strain Injury or cumulative trauma disorders.

Within this application, the following terms are used both in the specification and the claims and should be understood to have the following definitions:

The term "resting convergence point" means the point at which the eyes will converge with minimum muscle tension either outwardly or inwardly than would cause convergence at some other either closer or farther point.

The term "counterbalancing" refers to compensating for the weight of a supporting structure plus what is carried by such supporting structure so that such supporting structure may be moved with a minimum of force.

The term "a force minimum" means movement of an object may be accomplished by the exertion of no more than a few pounds of force less, than about eight (8) pounds of force, or such force as may be exerted by a young child or an old person with little effort.

The term "infinitely variable triangle" means an imaginary triangle which may take any shape or size within predetermined size limitations set by the dimensions and interrelationships the apparatus.

While the present invention has been described at some length and with some particularity with respect to several described embodiments, it is not intended that it should be limited in any such particulars or any particular embodiment but is to be construed broadly with reference to the appended claims so as to provide the broadest possible interpretation of such claims in view of the prior art and therefore to effectively encompass the intended scope of the invention.

I claim:

1. An ergonomically designed computer work station comprising:

(A) a base means for location in a stationary position upon a supportive surface adjacent to a reference position, being the intended or projected work position of a computer operator, (B) a video monitor support means mounted upon such base, (C) said support means being universally adjustable within mechanically predetermined outer limits to any position in a vertically oriented plane passing through said projected work position and the base of the support means, (D) said support means being adjustable along the plane in upwardly and downwardly and forwardly and backwardly directions in every position on the plane within the predetermined limits, (E) said support means being constructed as a paired structures mechanically counterbalanced such that when adjusted for the weight of the support and a video monitor it can be moved along the plane with only a minimum exertion of force and upon removal of said force will remain in the position in which it was at the cessation of the application of the force, (F) the especially predetermined outer limits of movement in the vertical plane being from a position within less than one dimension of the video monitor from the supportive surface to not less than substantially eye level of a projected operator in the reference position in a vertical direction and in a horizontal direction not less than from substantially directly over the base to within about a horizontal distance from the reference position which is the long leg of a right triangle the hypotenuse of which is the resting convergence distance of an average human eye with a line of vision extending at a downward angle of thirty-five degrees, (G) a keypad supported in a counterbalanced fashion upon two support arms at least indirectly mounted with respect to said base means such that said keypad is movable in a vertical plane passing through the reference position at least twelve inches in a vertical direction as well between, (H) the keypad support arms being mechanically counterbalanced such that the keypad can be moved to a desired vertical position with only a minimum of exertion of force and upon removal of said force will remain in the position in which it was upon the cessation of the removal of the force, (I) a locking means for rendering the keypad immovable during contact with the hands of an operator at the reference position during the keying in of data upon a keyboard supported by the keypad.

2. An ergonomically designed computer workstation in accordance with claim 1 wherein a force required to move the computer monitor is not greater than six (6) pounds.

3. An ergonomically designed computer workstation in accordance with claim 2 wherein the force required to move the computer monitor is not greater than four (4) pounds and the force to move the keypad is not greater than three (3) pounds.

4. An ergonomically designed computer work station in accordance with claim 1 wherein the video monitor support means is arranged and constructed such that the video monitor view screen is inclined to maintain it perpendicular to the line of sight of an operator seated at the reference position of the input station over a range of elevations of the video monitor.

5. An ergonomically designed computer work station in accordance with claim 4 wherein the keypad support is arranged and constructed to be have its inclination mechanically varied so it may be inclined both forwardly and backwardly.

6. An ergonomically designed computer work station in accordance with claim 5 wherein the components of the computer work station are incorporated into a piece of furniture having an upper work surface and at least two side surfaces.

7. An ergonomically designed computer work station in accordance with claim 5 wherein the monitor support and the keypad support are counterbalanced by spring means.

8. An ergonomically designed computer work station in accordance with claim 7 wherein the monitor support is arranged and constructed to raise the monitor to an elevation above the line of sight of the position of an operator seated at the work station while maintaining the inclination of the monitor perpendicular to the line of sight of the operator.

9. An ergonomically designed computer work station in accordance with claim 7 wherein the keypad support means is arranged and designed to support varying keypads attached to such supports to provide different keypad configurations in accordance with the desire of the operator.

10. An ergonomically designed computer work station in accordance with claim 7 wherein the upper edges of the keypad are rounded to eliminate any angular surfaces that might protrude against the hands or wrists of the operator.

11. An ergonomically designed computer work station in accordance with claim 5 wherein the two keypad support arms are connected by a coordinating bar which serves also as a brace for the keypad.

12. An ergonomically designed computer workstation in accordance with claim 7 wherein an interlock on the keypad support arms allows the keypad to be raised without release of such interlock, but restricts downward movement unless such lock is released.

13. An ergonomically designed computer workstation in accordance with claim 7 wherein the range of movement of the video monitor support means is 12 inches in the vertical direction and 12 inches in the horizontal direction and the range of movement of the keypad is twelve inches in the vertical direction.

14. An ergonomically designed computer work station in accordance with claim 13 wherein the range of movement of the video monitor support means is 16 inches in the vertical direction and 12 inches in the horizontal direction.

15. A computer monitor support for an ergonomically designed computer station comprising a dual pair of articulated spring counterbalanced support arms having at least two continuous articulated leg portions including upper and lower leg portions the lower leg portion being pivotably mounted upon a base and the upper leg portion having a monitor support means pivoted to said upper leg portion for motion about a horizontal axis toward and away from the upper leg portion by means of a single link lever means provided between a side of the upper leg and one end of the monitor support means such that as the two articulated leg portions are folded together lowering the monitor support means and any monitor supported thereupon the monitor support means is inclined progressively upwardly to maintain the view screen of any such monitor substantially perpendicular to the line of sight of an operator seated at a reference position in relation to the computer station.

16. A method of preventing repetitive strain injuries in computer operators comprising:

(1) providing a computer work station incorporating:

(a) a dual video monitor support adjustable for movement within predetermined outer limits to any position upon a plane positioned substantially vertically and passing through the video monitor support and the position of the operator of such station, (b) a keypad supported by keypad support arms which allow the keypad to be adjusted to any position in the plane of monitor support adjustment within predetermined verified limits, (c) said adjustable positions of the video monitor support and keypad support and associated keypad approaching each other and the keypad being also adjustable to various angles, (2) adjusting the monitor support and the keypad support and associated keypad to a first position relative to each other and the reference position and maintaining such position for a short period, (3) readjusting the monitor support and keypad support and associated keypad to a second position relative to each other and maintaining such position for a short period, (4) repeating the adjustment of the monitor support and keyboard support periodically throughout the working period of an operator at the computer work station.

17. A method of preventing repetitive strain injuries in computer operations in accordance with claim 16 wherein the adjustment of the monitor support and the keyboard supports include adjustment of such supports in a series of a large number of different relative positions with each other, each relative position being dissimilar from previous positions through a plurality of changes before any given relative position is repeated.

18. A method of preventing repetitive strain injuries in computer operators in accordance with claim 17 wherein the relative positions of the keypad supports and associated keypad include various inclinations of the keypad and associated keyboard.

* * * * *